US006850779B1

(12) United States Patent
Iguchi et al.

(10) Patent No.: US 6,850,779 B1
(45) Date of Patent: Feb. 1, 2005

(54) MOBILE COMMUNICATION ANTENNA AND MOBILE COMMUNICATION APPARATUS USING IT

(75) Inventors: Akihiko Iguchi, Osaka (JP); Susumu Fukushima, Osaka (JP); Yuki Satoh, Osaka (JP); Naoki Yuda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/744,021

(22) PCT Filed: May 19, 2000

(86) PCT No.: PCT/JP00/03206

§ 371 (c)(1),
(2), (4) Date: Mar. 12, 2001

(87) PCT Pub. No.: WO00/72404

PCT Pub. Date: Nov. 30, 2000

(30) Foreign Application Priority Data

May 21, 1999 (JP) ..... 11/141879
Aug. 5, 1999 (JP) ..... 11/222407
Mar. 14, 2000 (JP) ..... 2000/70038

(51) Int. Cl.[7] ..... H01Q 1/38

(52) U.S. Cl. ..... 455/562.1; 455/525.7; 343/722

(58) Field of Search ..... 455/55.01, 90.3, 455/575.7, 562.1, 575.1, 272–274, 276.1, 277.1, 279.1, 82, 83; 343/722, 702, 700 MS, 895, 749, 873, 893

(56) References Cited

U.S. PATENT DOCUMENTS 6,075,491 A * 6/2000 Dakeya et al. ..... 343/722
6,597,315 B2 * 7/2003 Yokoshima et al. . 343/700 MS
6,606,060 B2 * 8/2003 Park ..... 343/700 MS
6,630,906 B2 * 10/2003 Tomomatsu et al. . 343/700 MS
6,653,977 B1 * 11/2003 Okabe et al. ..... 343/700 MS
6,680,713 B2 * 1/2004 Yokoshima et al. ..... 343/895

FOREIGN PATENT DOCUMENTS

| | | |
|---|---|---|
| EP | 0 777 293 A | 6/1997 |
| EP | 0 871 238 A | 10/1998 |
| EP | 0 878 863 A | 11/1998 |
| JP | 5-275919 | 10/1993 |
| JP | 7-312520 | 11/1995 |
| JP | 11027026 | 4/1997 |
| JP | 9-162624 | 6/1997 |
| JP | 10-173427 | 6/1998 |
| JP | 10-190330 | 7/1998 |
| JP | 10-200318 | 7/1998 |
| JP | 11-4113 | 1/1999 |
| JP | 11-27026 | 1/1999 |
| JP | 11-41019 | 2/1999 |
| JP | 11-41025 | 2/1999 |
| JP | 11068449 | 6/1999 |
| JP | 2000-22429 | 1/2000 |
| WO | WO 99 03166 A | 1/1999 |

* cited by examiner

*Primary Examiner*—Pablo N. Tran
(74) *Attorney, Agent, or Firm*—McDermott Will & Emery LLP

(57) ABSTRACT

The present invention relates to an antenna equipped in a mobile telecommunication apparatus such as a portable telephone. The object of the invention is to enhance the portability and the durability of the mobile telecommunication apparatus, to provide a mobile telecommunication antenna while is improved in the mass productivity and the electrical characteristics, and to provide a mobile telecommunication apparatus employing the antenna. To achieve the object of the present invention, the mobile communication apparatus has no projecting portion of the antenna provided on a case, and the antenna is accommodated in the case. This enhances both the portability and the durability. Also, the antenna is reduced to a chip size thus improving its mass-productivity and electrical characteristics.

77 Claims, 40 Drawing Sheets

(a)

(b)

(a)

(b)

(a)

(b)

(a)

(b)

(a)

(b)

MOBILE COMMUNICATION ANTENNA AND MOBILE COMMUNICATION APPARATUS USING IT

TACHNICAL FIELD

The present invention relates to a mobile telecommunication antenna used in a portable telephone or the like and a mobile telecommunication apparatus equipped with the mobile telecommunication antenna.

BACKGROUND ART

Mobile telecommunication apparatuses such as portable telephones or pagers have rapidly been commercialized. FIG. 40 illustrates a common portable telephone as a mobile telecommunication apparatus.

As shown, reference numeral 10 denotes a portable telephone, and reference numeral 11 denotes a case of it. Antenna 5 is disposed in parallel with the longitudinal direction of case 11 and extending outwardly from case 11. Antenna 5 is joined at one end with power supply 13 mounted in the case for feeding a high-frequency signal. In the figure, reference numeral 1 denotes a microphone, reference numeral 2 denotes an operation unit, reference numeral 3 denotes a display, and reference numeral 4 denotes speaker.

In such a conventional construction of the portable telephone, the extending antenna declines portability as a portable telephone accordingly declines. Also, the antenna is fragile and may be easily broken by any abrupt shock, for example, in dropped down.

In the manufacturing process of the portable telephones, the antenna has to be mounted to the case by manually tightening screws. The process can be hardly automated thus increasing the overall cost of manufacturing.

Also, the conventional telephone construction requests the antenna and a high-frequency circuit to be electrically connected to each other by a dedicated a connecting component, which possibly claims the cost-up, causes the power loss, and thus is also unfavorable in the electrical characteristics.

DISCLOSURE OF THE INVENTION

The present invention eliminates the foregoing problems, and the object of the invention is to provide a mobile telecommunication antenna enhancing the portability, the durability of a mobile telecommunication apparatus such as a portable telephone, mass-productivity, and the electrical characteristics. And also, the object is to provide a mobile telecommunication apparatus employing the antenna.

For achieve the object of the present invention, the antenna does not project outwardly from the case of the mobile communication apparatus, and the antenna is accommodated in the case. That results to enhance the portability and durability of the apparatus. Also, the antenna is formed in a chip size, thus improving the mass-productivity and the electrical characteristics thereof.

DETAILED DESCRIPTION OF THE PREFERRED EMBODIMENT (Embodiment 1)

Figure 1:
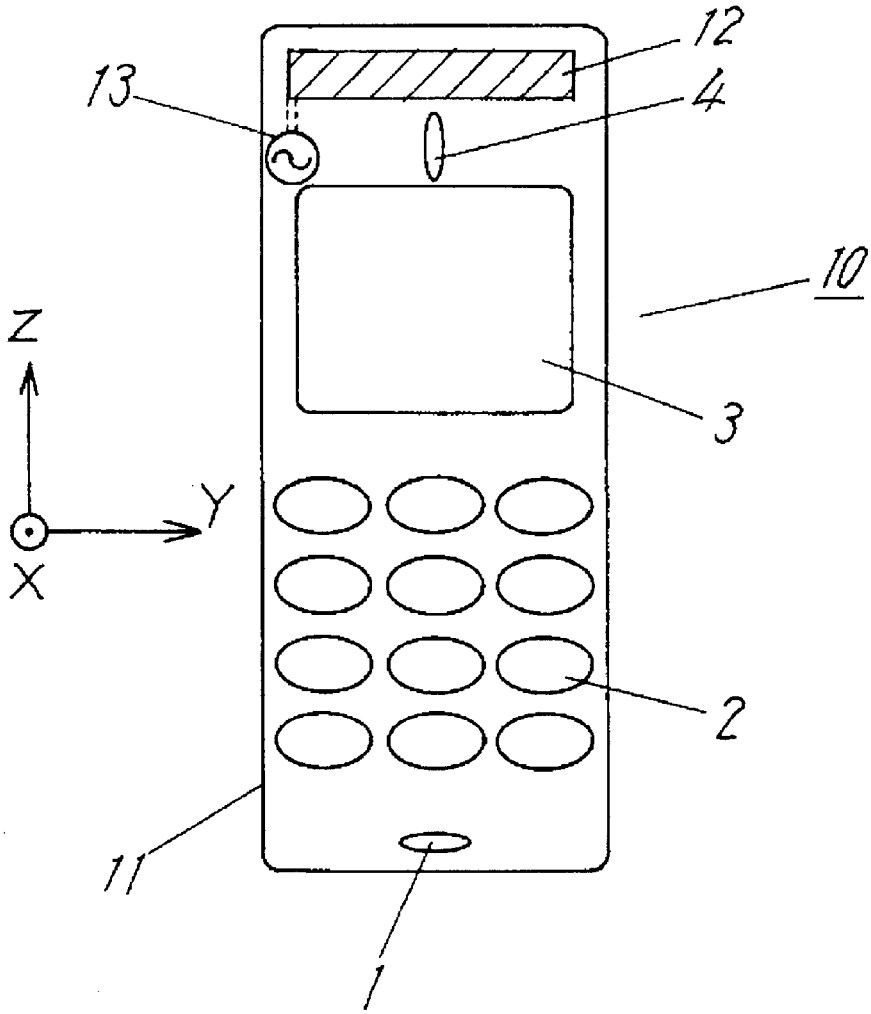
FIG. 1 is a schematic view of a portable telephone according to Embodiment 1 of the present invention.

FIG. 1 is a schematic view of a portable telephone according to Embodiment 1 of the present invention. Reference numeral 10 denotes a portable telephone, reference numeral 11 denotes its case. Antenna 12 having a radiation-conductive element is mounted in case 11 substantially vertical to the longitudinal direction of case 11 and not project outwardly from case 11. Antenna 12 is jointed at one end to power supply 13 mounted in case 11 for feeding a high-frequency signal. Reference numeral 1 denotes a microphone, reference numeral 2 denotes an operation unit, reference numeral 3 denotes a display, and reference numeral 4 denotes a speaker.

As shown, antenna 12 is disposed in case 11 substantially vertical to the longitudinal direction of case 11. That results that the telephone has no projecting portion, enhances its portability, and is protected from broken.

Figure 2:
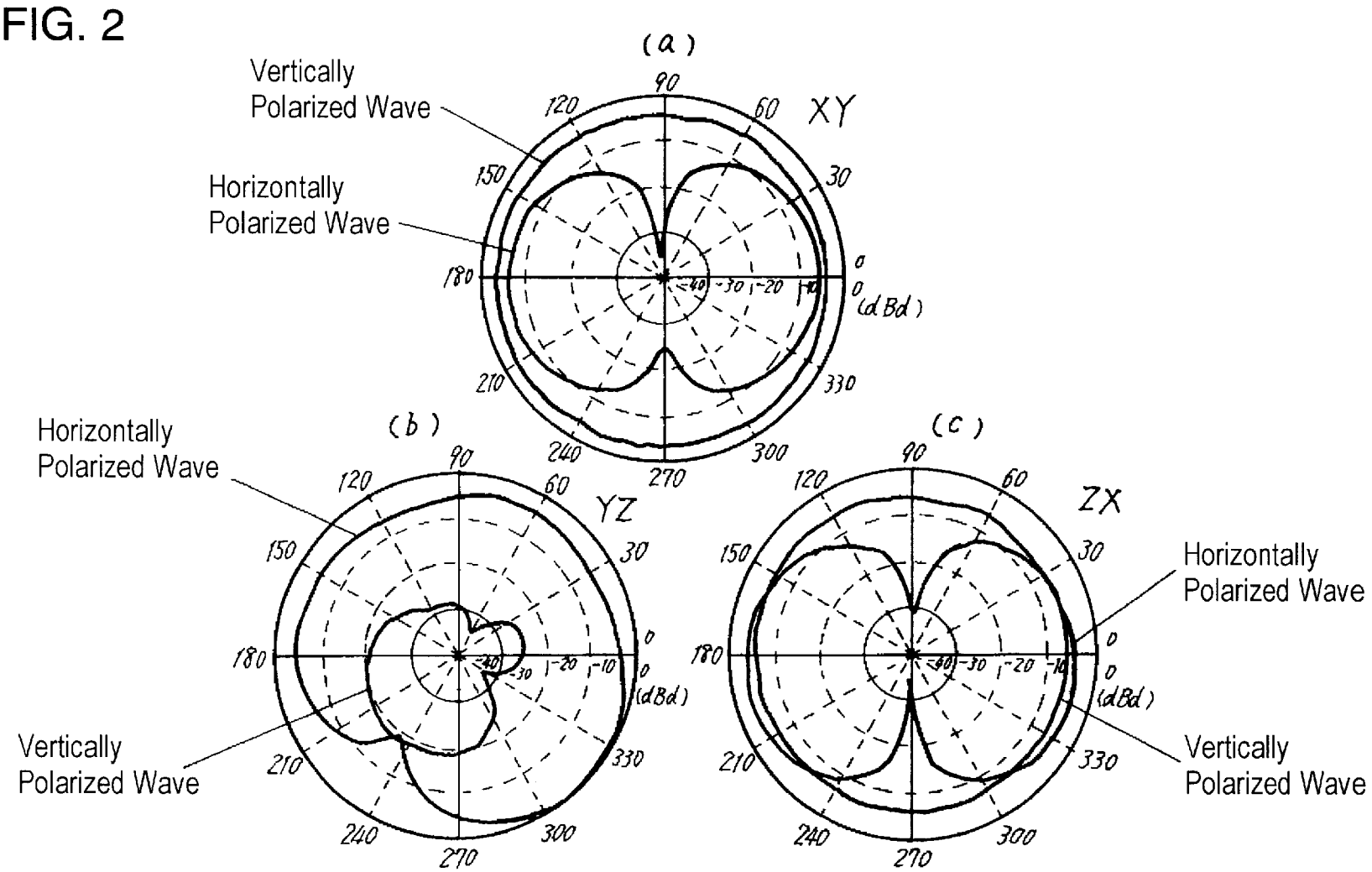
FIG. 2 is a radiation pattern of an antenna having a radiation-conductive element of substantially 1/2 wavelength according to the same embodiment.
Figure 3:
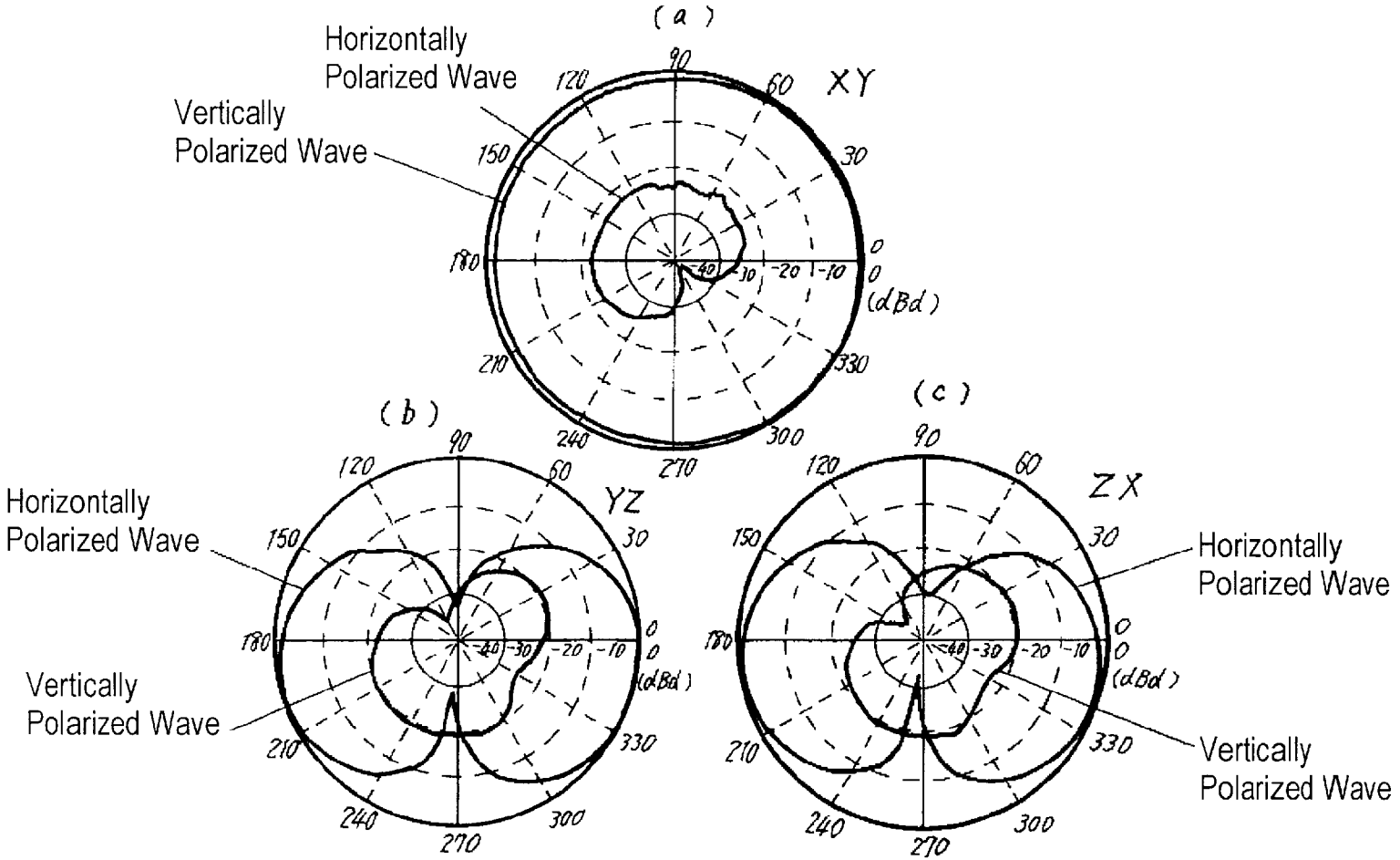
FIG. 3 is a radiation pattern of a conventional antenna, shown in FIG. 40, having a radiation-conductive element of substantially 1/2 wavelength.
Figure 40:
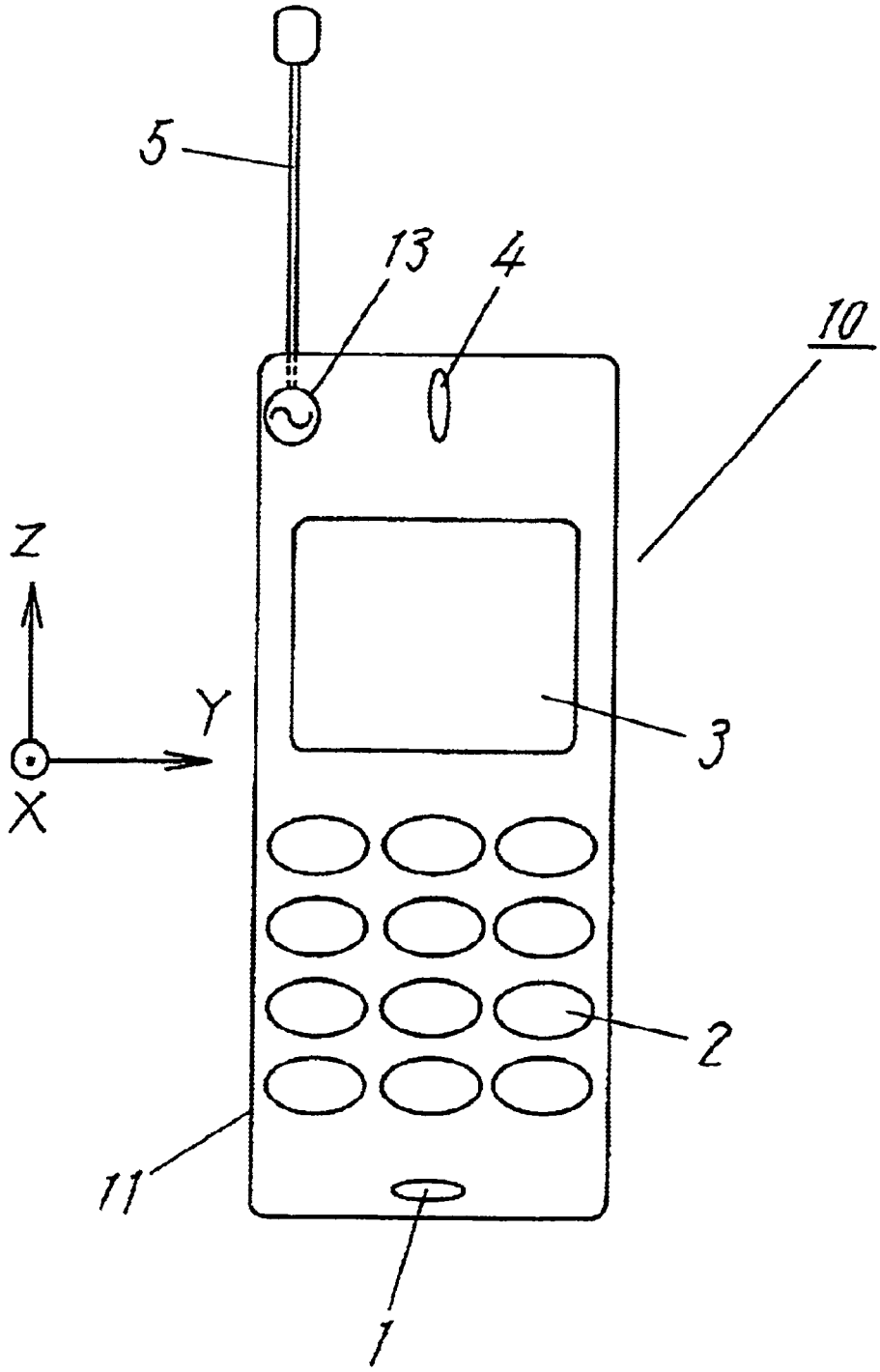
FIG. 40 is a perspective view of another conventional antenna.

FIG. 2 illustrates a radiation pattern of antenna 12 having a radiation-conductive element of substantially 1/2 wavelength. For comparison, FIG. 3 illustrates a radiation pattern of a conventional antenna (of which radiation-conductive element has 1/2 wavelength) disposed vertical to the longitudinal direction of the case as shown in FIG. 40. In common, portable telephone 10 is sensitive to a vertically polarized wave along the Z-axis radiated from case 11 and a horizontally polarized wave along the Y-axis radiated from the radiation-conductive element of antenna 12.

In comparison, the antenna according to this embodiment exhibits a sensitivity greater than or equal to −10 (dBd) to five different polarized waves, i.e., two in the XY plane, two in the ZX plane, and one horizontally polarized wave in the YZ plane as shown in FIG. 2. The conventional antenna exhibits a sensitivity greater than or equal to −10 (dBd) to three different polarized waves, i.e., one vertically polarized wave in the XY plane, one horizontally polarized wave in the YZ plane, and one horizontally polarized wave in the ZX plane as shown in FIG. 3. The antenna according to this embodiment works in more polarization planes, and its antenna characteristic is reduced in a declination in actual use.

As an antenna at a base station for the portable telephones is disposed generally in vertical, a vertically polarized wave often reach the portable telephones or mobile communication apparatuses. The antenna according to this embodiment enables to minimize declination in the sensitivity to the vertical polarized wave in actual use. This will be explained in more detail referring to FIG. 4 where the portable telephone is positioned in actual use corresponding to an ear and a mouth of a user.

As shown, portable telephone 10 in the use is tilted about 60° from the vertical, and its antenna characteristic to the vertically polarized wave may accordingly be declined. The radiation-conductive element of antenna 12 mounted in vertical to the longitudinal direction of case 11 is tilted only 30° from the vertical direction. Consequently, its antenna characteristic for the vertical polarized wave does not decline in actual use as compared with the conventional antenna, which is disposed in parallel with the longitudinal direction of the case.

Figure 4:
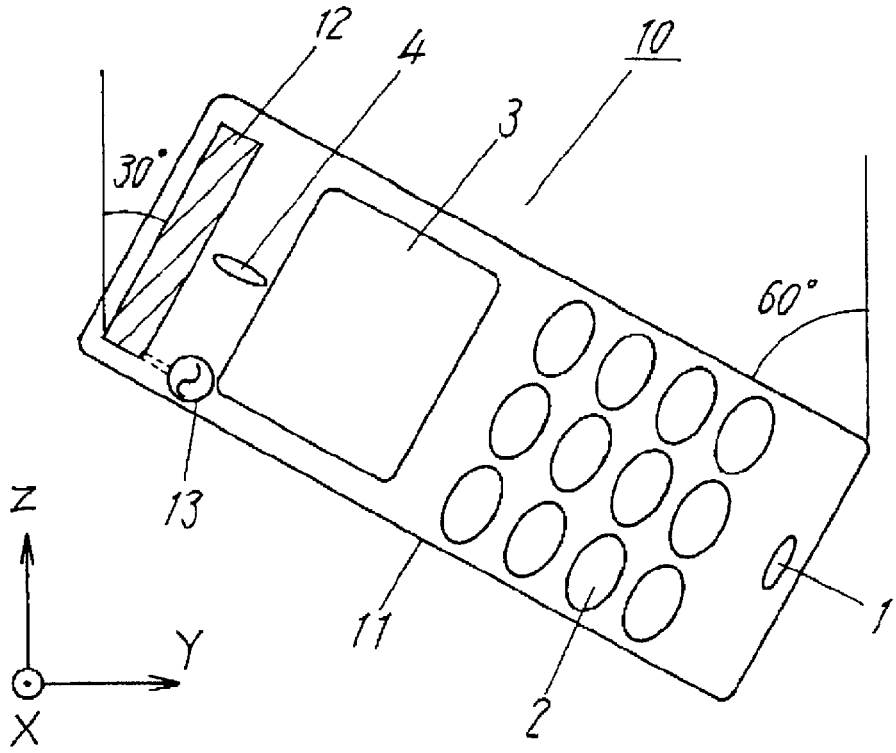
FIG. 4 is a schematic view showing the telephone according to the same embodiment in its actual use.
Figure 5:
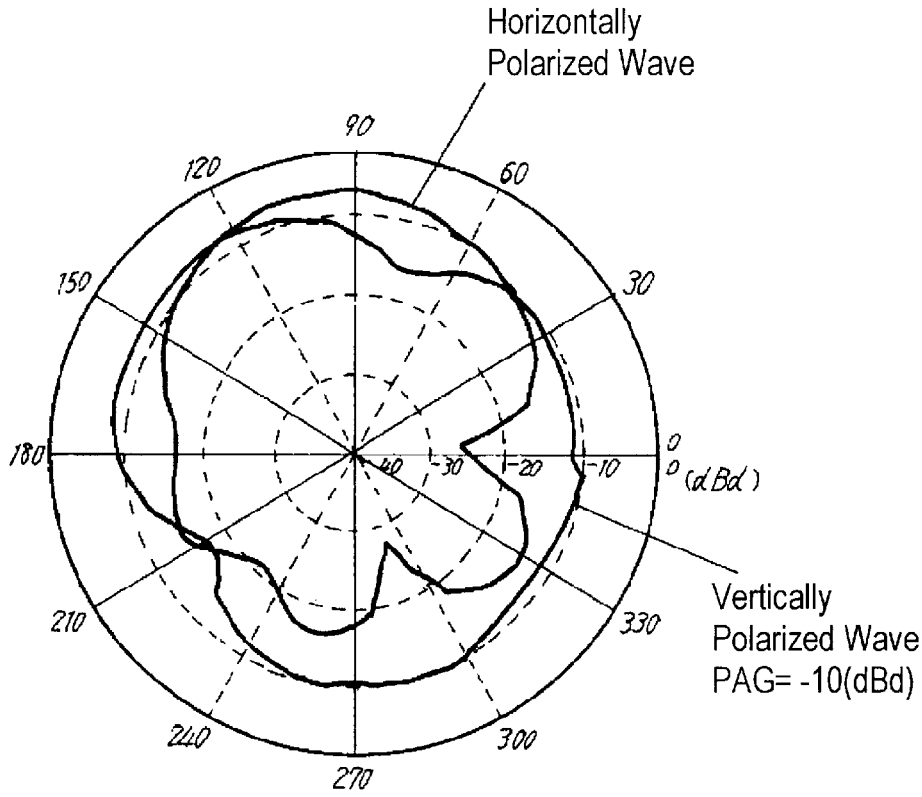
FIG. 5 is a radiation pattern of the antenna having a radiation conductive element of substantially 1/2 wavelength in its actual use according to the same embodiment.
Figure 6:
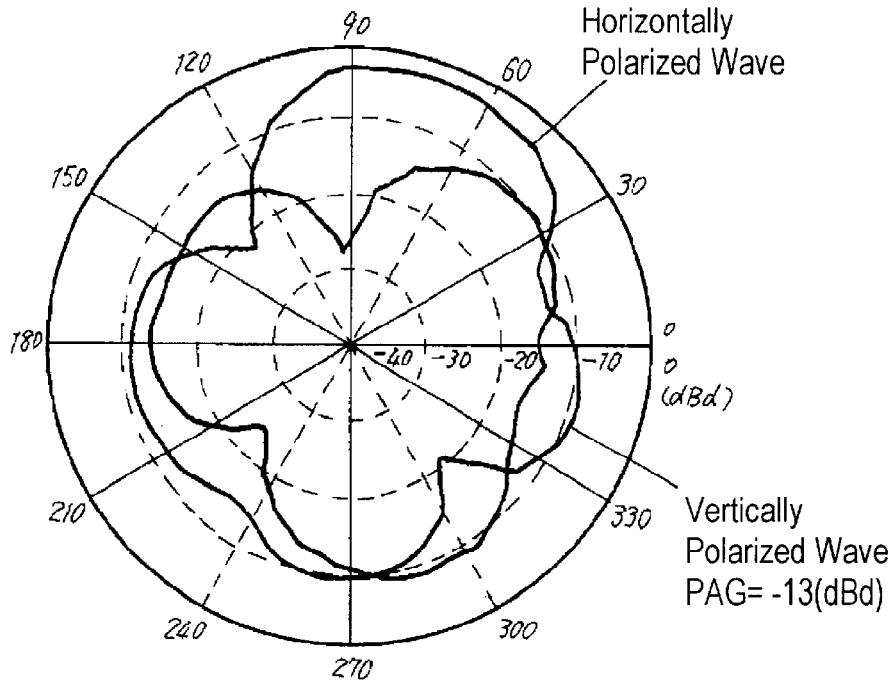
FIG. 6 is a radiation pattern of the conventional antenna having a radiation conductive element of substantially 1/2 wavelength in its actual use.
Figure 7:
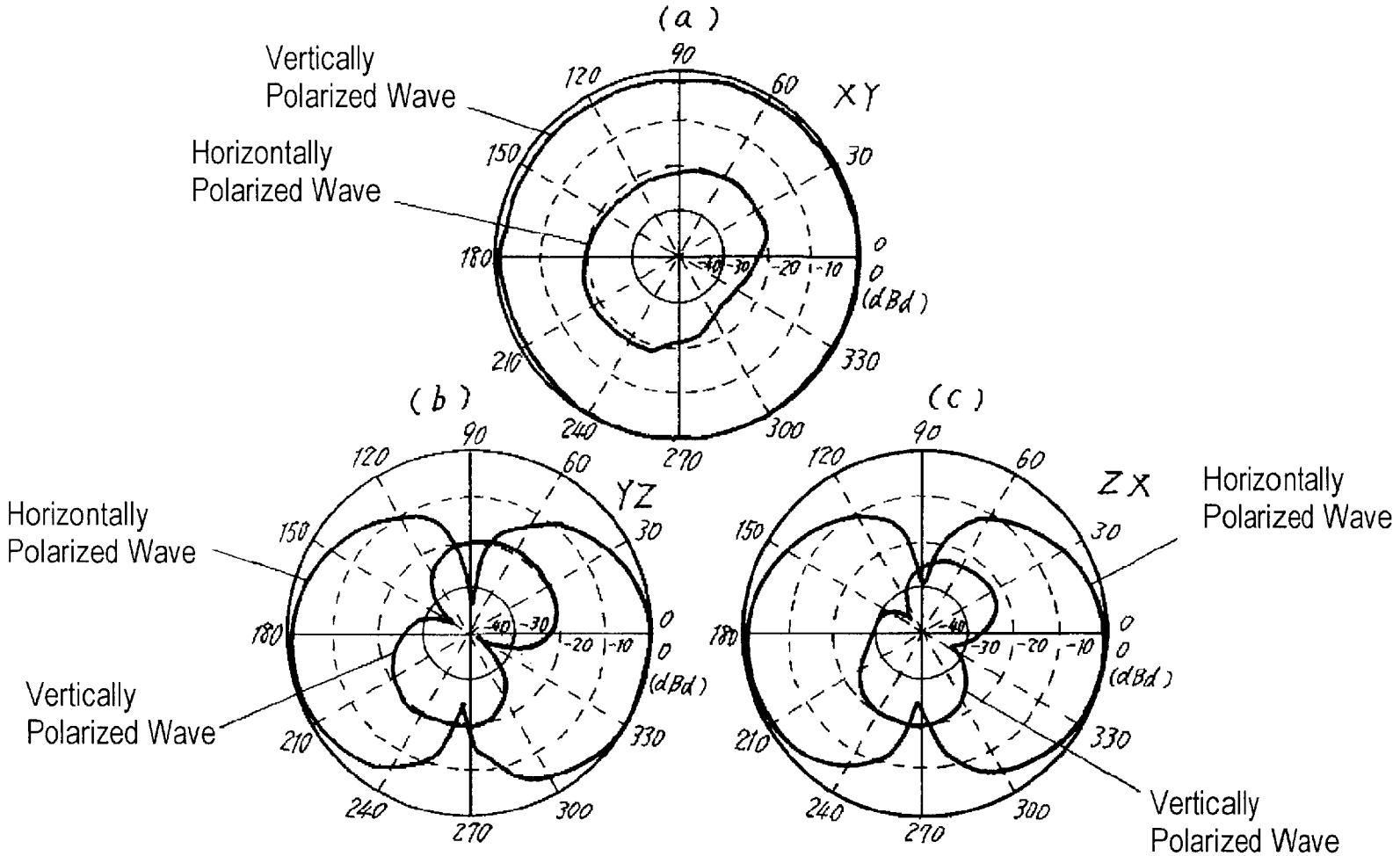
FIG. 7 is a radiation pattern of the antenna having a radiation-conductive element of substantially 1/4 wavelength according to the same embodiment.

FIG. 5 shows a radiation pattern of the antenna of the portable telephone operated at the position shown in FIG. 4. FIG. 6 shows that of the conventional portable telephone for comparison. As shown, a pattern average gain (PAG) to a vertically polarized wave of the portable telephone according to this embodiment in actual use is about 3 (dBd) higher.

Moreover, as the radiation-conductive element of antenna 12 is located at the upper end in case 11, it may hardly be covered with a hand of the user. That reduces a declination in the antenna characteristic caused by the user's body.

The radiation-conductive element is located at the upper end in the case, its electrical length is set to substantially an n/2 wavelength (where n is an odd number), and consequently, a current hardly runs along the case. Accordingly, even if the hand grips the case, an impedance change of the antenna as well as an attenuation of the antenna radiation is reduced, and the antenna characteristic is favorably reduced in a declination.

Also, the radiation-conductive element disposed substantially in vertical to the longitudinal direction of the case works as an antenna not only for the vertically polarized wave but also for the horizontally polarized wave. Consequently, the antenna characteristic is reduced in the declination in actual use.

Figure 8:
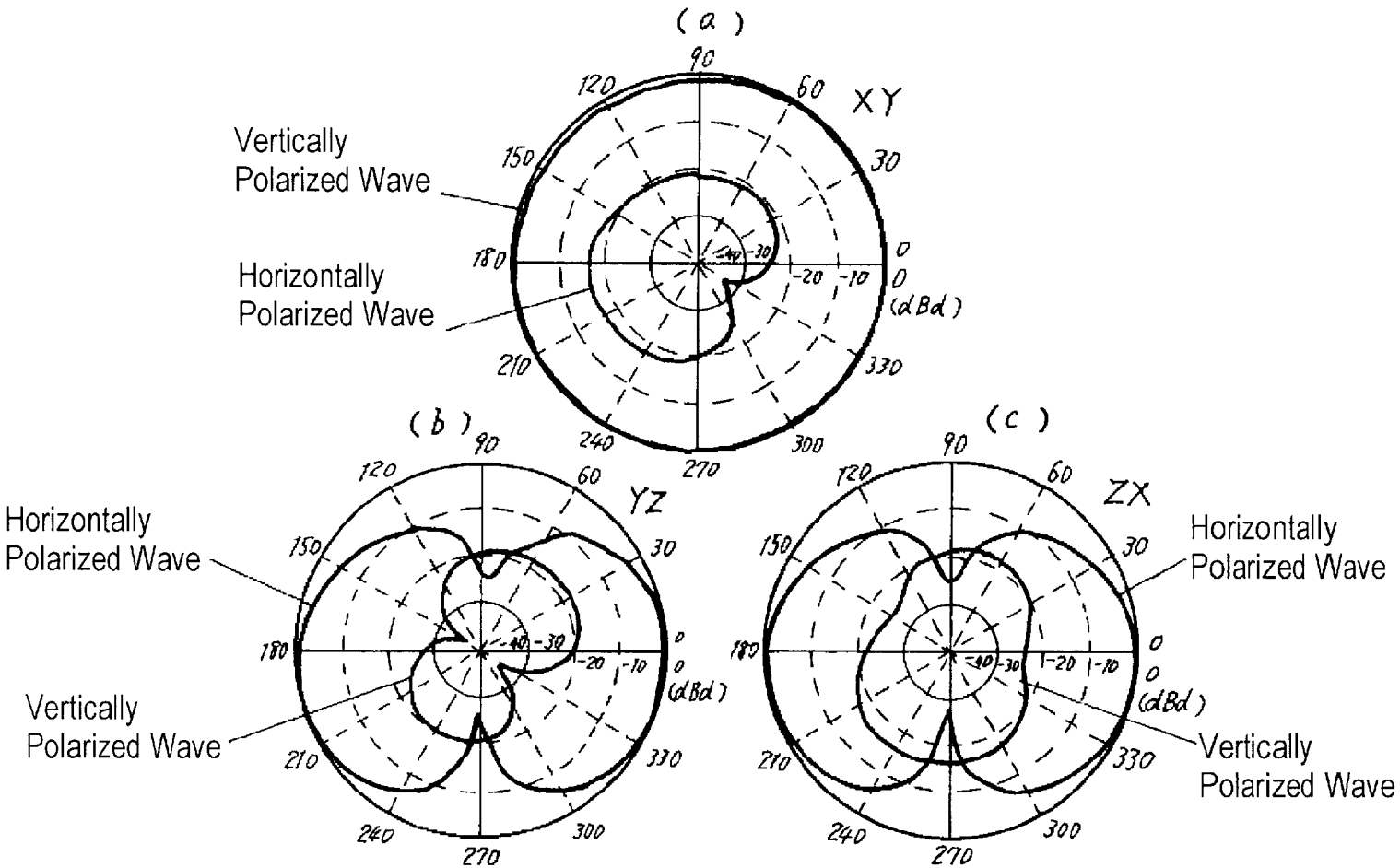
FIG. 8 is a radiation pattern of the conventional antenna having a radiation-conductive element of substantially 1/4 wavelength.

FIG. 5 shows an antenna radiation pattern of antenna 12 having the radiation conductive element of substantially 1/4 wavelength. For comparison, FIG. 8 shows an antenna radiation pattern of the conventional antenna (of which radiation conductive element has substantially a 1/4 wavelength) disposed in vertical to the longitudinal direction of the case. As shown in comparing these, substantially the same radiation characteristic as of the projecting antenna is obtainable even if the antenna having the radiation-conductive element is disposed in substantially vertical to the longitudinal direction of the case, and a portability of a mobile telecommunication apparatus is improved thanks to the non-projecting antenna.

When the electrical length of the radiation conductive element is substantially an n/4 wavelength (where n is an odd number), a more current runs through the case. This causes the antenna impedance to be changed when the case is gripped by the hand, hence making the impedance matching difficult and making the antenna radiation unfavorable. Accordingly, the antenna characteristic may marginally be declined. On the contrary, the impedance of the antenna is close to 50Ω when the case is not touched by the hand, and thus, a matching circuit can be omitted. The fabricating process hence increases in the efficiency and decreases in the cost.

(Embodiment 2)

The construction of antenna 12 shown in FIG. 1 will be described in more detail referring to FIGS. 9 through 28. The antenna construction here is designed for transmitting and receiving signals in two different frequency bands, but not limited to it. Throughout the drawings, like components are denoted by like numerals, and their description will not be repeated.

Figure 9:
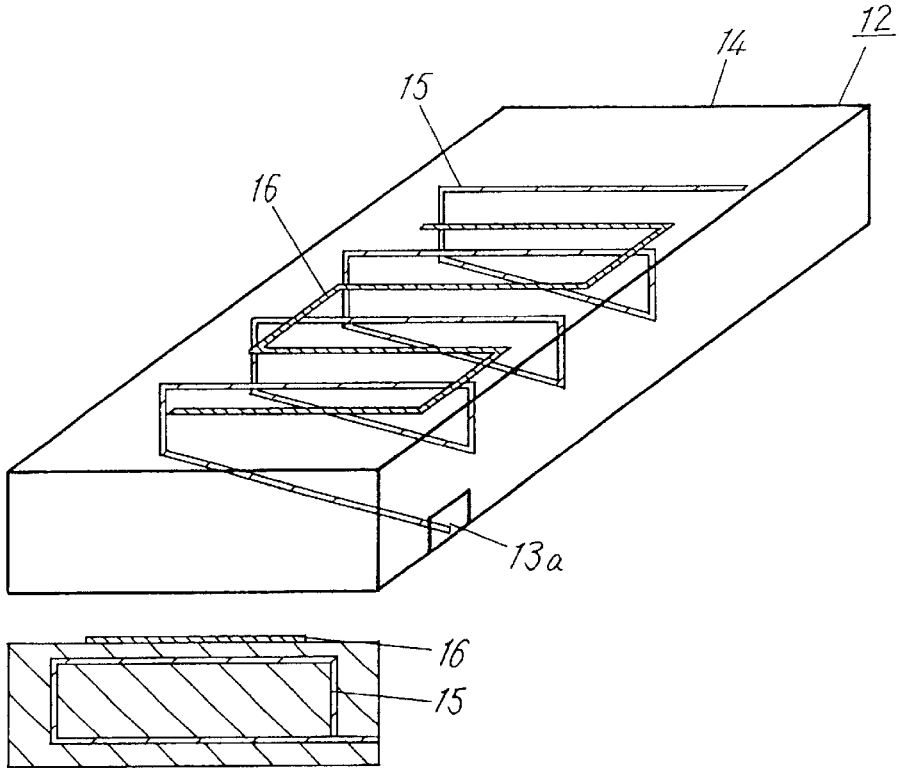
FIGS. 9(*a*) and 9(*b*) are a perspective view and a cross sectional view of an antenna according to Embodiment 2 of the present invention.

In FIG. 9, reference numeral 12 denotes an antenna. First radiation-conductive element 15 is arranged in a helical form in, dielectric substrate 14 and second radiation-conductive element 16 is arranged in a zigzag, meander form on the top of or within the dielectric substrate 14 over first radiation-conductive element 15.

First radiation conductive element 15 and second radiation conductive element 16 are insulated from each other while only first radiation conductive element 15 is connected to power supply terminal 13*a* for feeding a high-frequency signal.

Second radiation conductive element 16 is fed with a high-frequency signal by an electromagnetic coupling effect with first radiation conductive element 15. This allows first radiation-conductive element 15 and second radiation-conductive element 16 to resonate at different frequencies, thus permitting to transmit and receive signals at each two different frequency, respectively.

Dielectric substrate 14 is formed by laminating plural dielectric layers and assembling them to a single unit. Patterns of conductors and relevant through-holes at specific positions on specific layers are arranged to form desired shapes of first radiation conductive element 15 and second radiation conductive element 16. Other modifications of this embodiment described blow are also implemented through forming first radiation conductive element 15 and second radiation conductive element 16 of desired shapes.

The first and second radiation-conductive elements may be accompanied with a third, a fourth, and more radiation-conductive elements which are disposed at different locations and electrically insulated from the first and second radiation-conductive elements. And the antenna can accordingly transmit and receive signals at a more number of frequency bands. The radiation-conductor elements may be selected from helical elements, meander elements, linear elements, sheet elements, cylindrical elements, and their combinations.

Accordingly, while the apparatus is capable of transmitting and receiving the plural frequency bands of signals, its overall dimensions can significantly be reduced.

The antennas shown in FIGS. 9 through 14 commonly comprise first radiation conductive element 15 formed of a helical element connected to power supply terminal 13*a* for feeding a high-frequency signal, second radiation conductive element 16 formed of a meander element of zigzag shape. Those differ from each other in the relationship between positions of first radiation conductive element 15 and second radiation conductive element 16.

Figure 10:
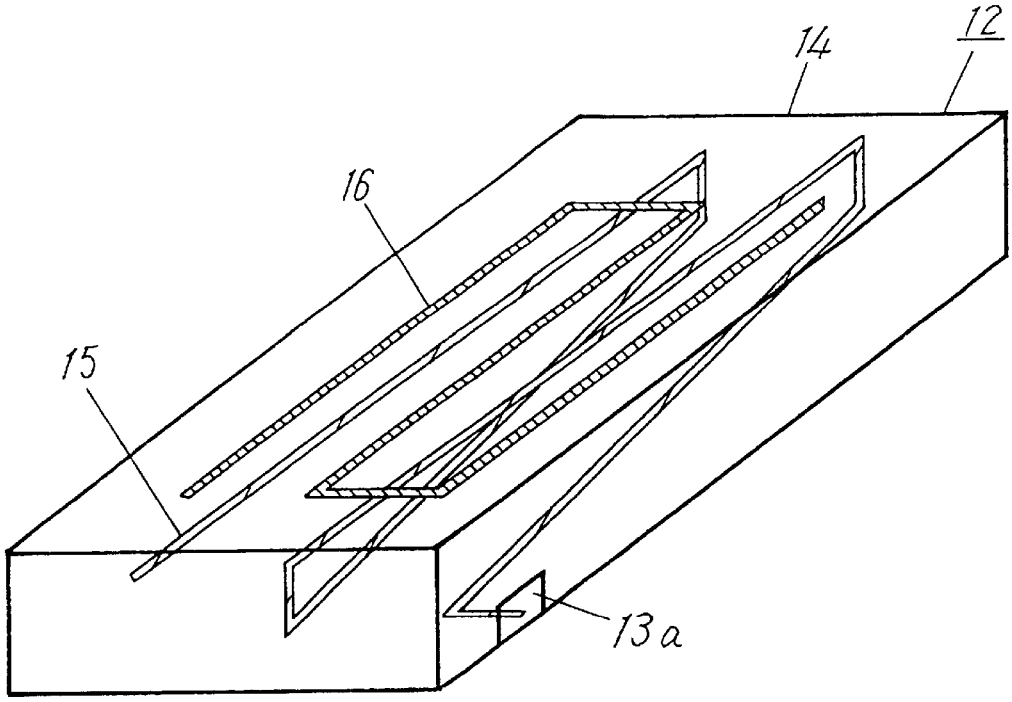
FIG. 10 is a perspective view showing a modification of the antenna according to the same embodiment.

More specifically, FIG. 9 illustrates the helical axis of helical element 15 and the zigzag direction of meander element 16 both arranged substantially in parallel with the longitudinal direction of dielectric substrate 14. FIG. 10 shows the elements are arranged substantially orthogonal to the longitudinal direction.

Figure 11:
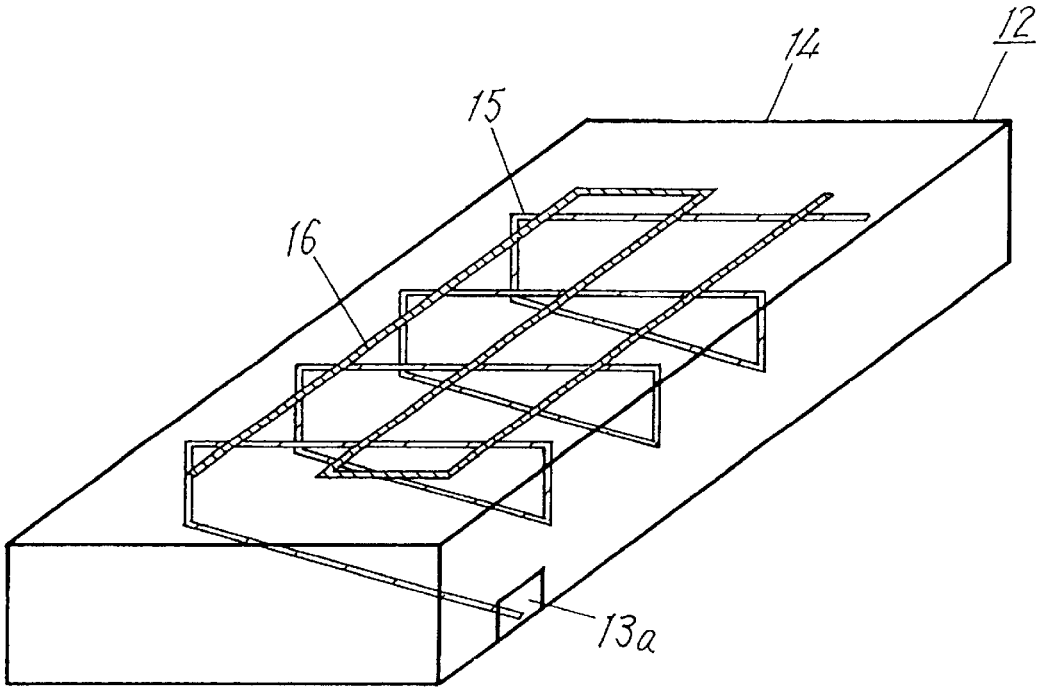
FIG. 11 is a perspective view showing another modification of the antenna according to the same embodiment.
Figure 12:
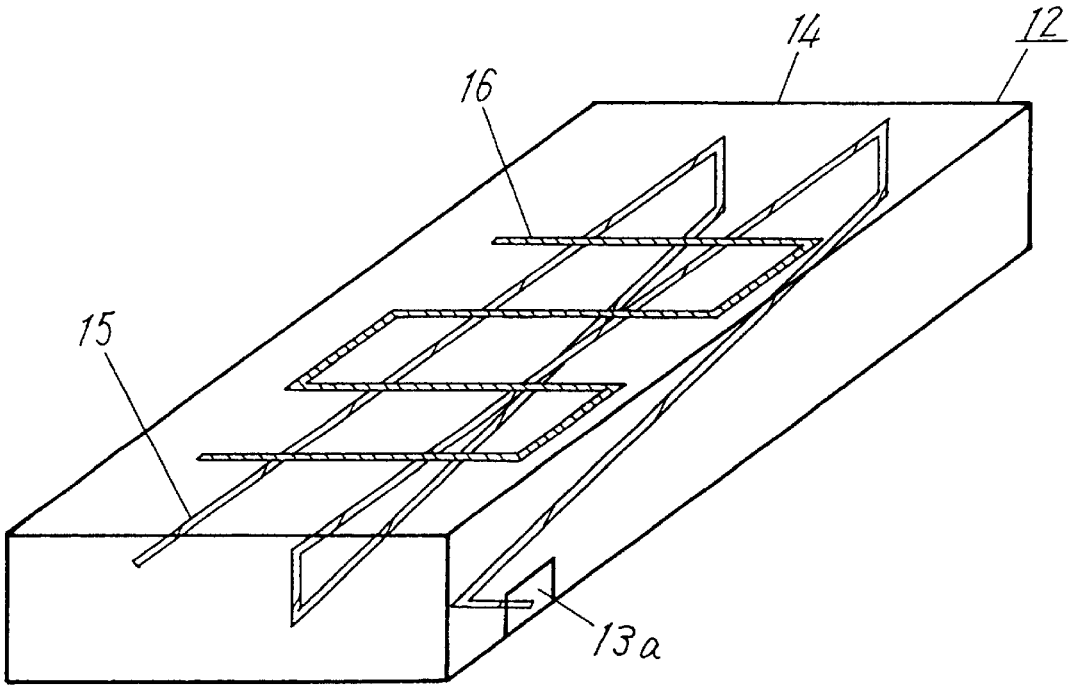
FIG. 12 is a perspective view showing a further modification of the antenna according to the same embodiment.

FIG. 11 illustrates the helical axis of helical element 15 arranged substantially in parallel with the longitudinal direction of dielectric substrate 14 while the zigzag direction of meander element 16 arranged substantially orthogonal to the longitudinal direction. FIG. 12 is the reverse to that, where the helical axis of helical element 15 arranged substantially orthogonal to the longitudinal direction of dielectric substrate 14 while the zigzag direction of meander element 16 is arranged substantially in parallel with the longitudinal direction.

Figure 13:
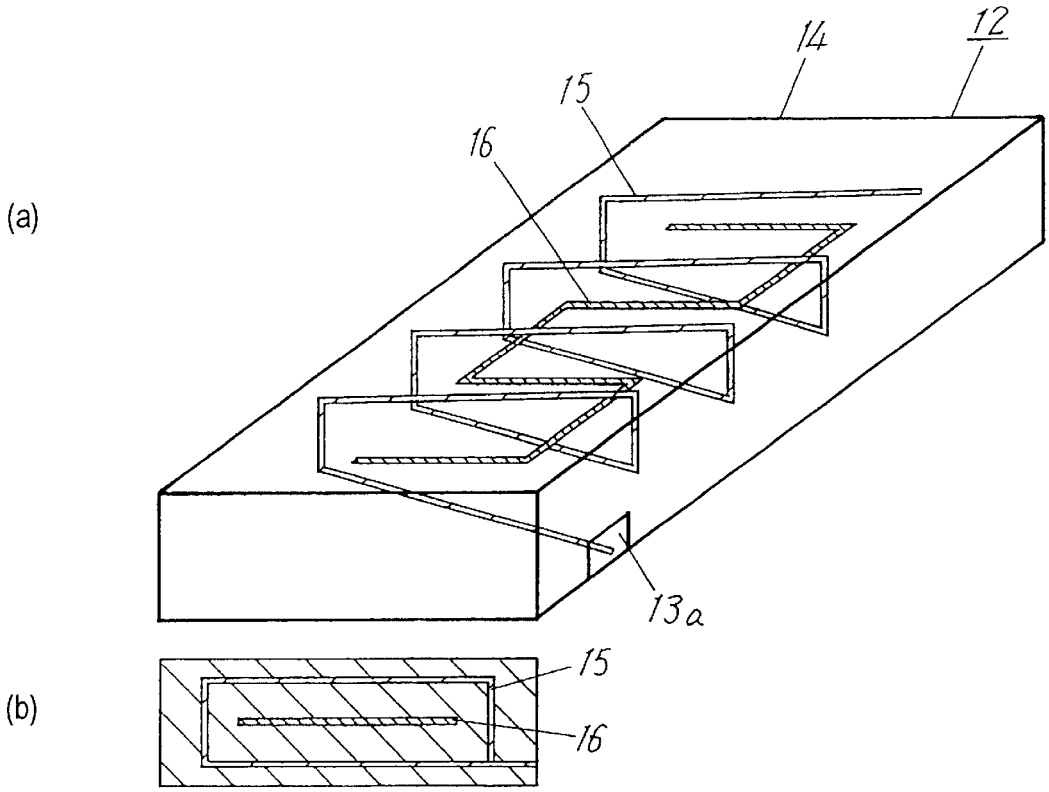
FIGS. 13(*a*) and 13(*b*) are a perspective view and a cross sectional view showing a still further modification of the antenna according to the same embodiment.
Figure 14:
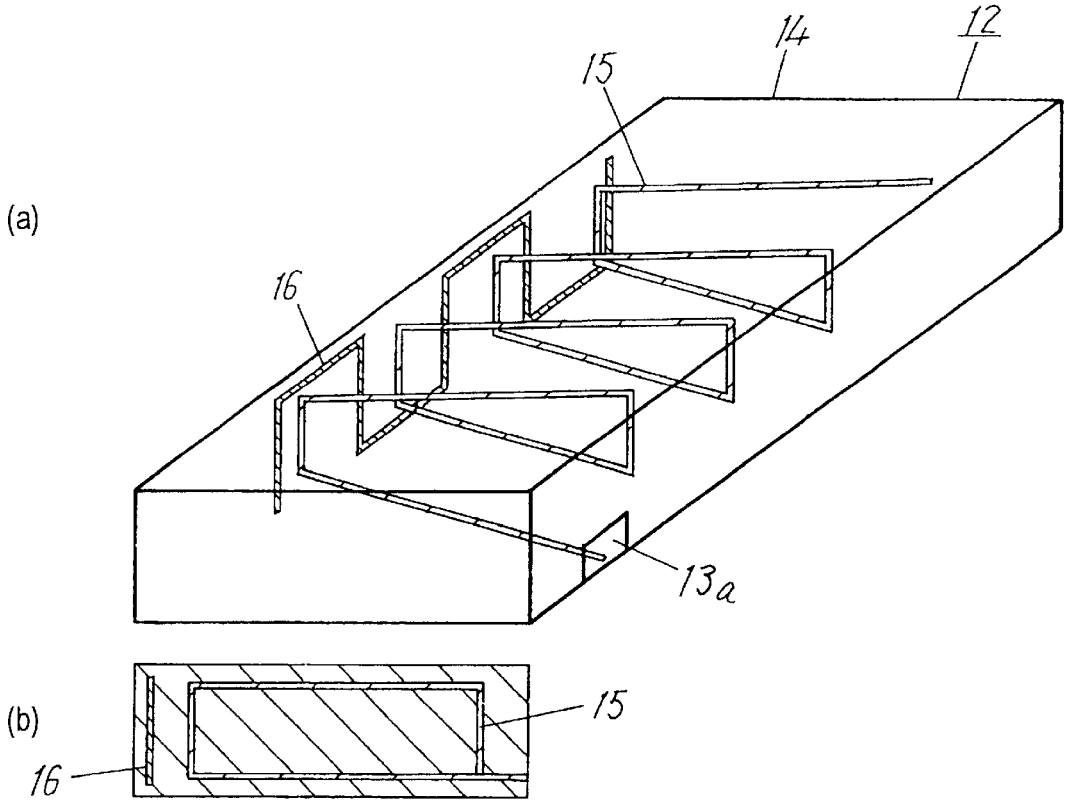
FIGS. 14(*a*) and 14(*b*) are a perspective view and a cross sectional view showing a still further modification of the antenna according to the same embodiment.

FIG. 13 illustrates meander element 16 disposed along the center of the helical element 15 while two elements 15 and 16 are arranged as shown in FIG. 9. FIG. 14 illustrates meander element 16 located on the side of helical element 15.

The antennas shown in FIGS. 15 through 18 commonly comprise first radiation-conductive element 17 and second radiation-conductive element 18 both arranged of a helical shape, where only first radiation conductive element 17 is connected to power supply terminal 13*a* for feeding high-frequency signals. Those differ from each other in the relationship between positions of first radiation conductive element 17 and second radiation conductive element 18.

Figure 15:
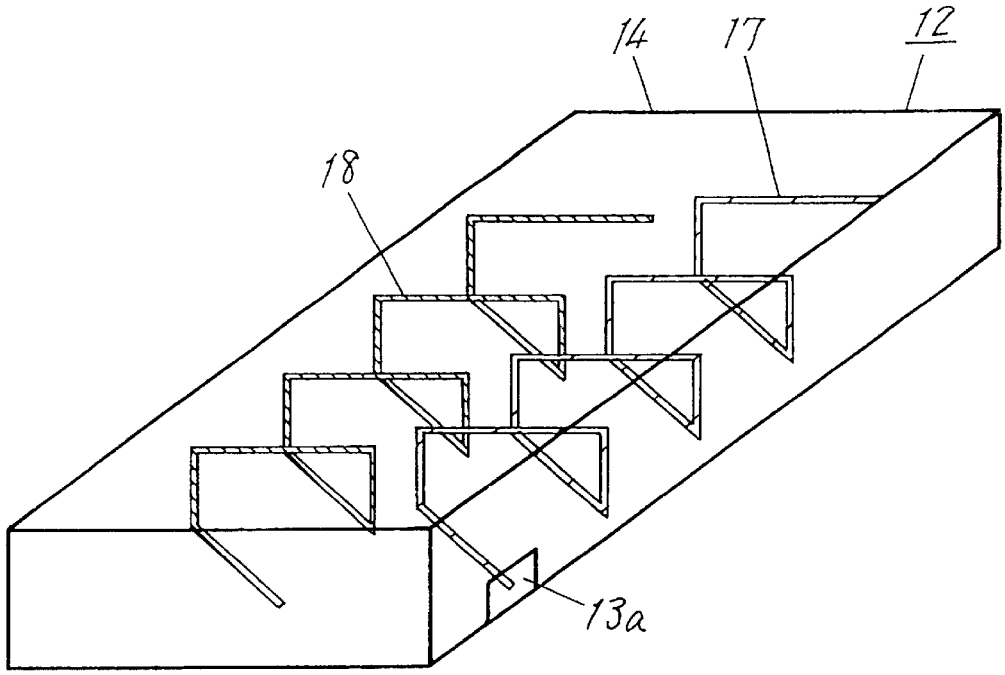
FIG. 15 is a perspective view showing a still further modification of the antenna according to the same embodiment.
Figure 16:
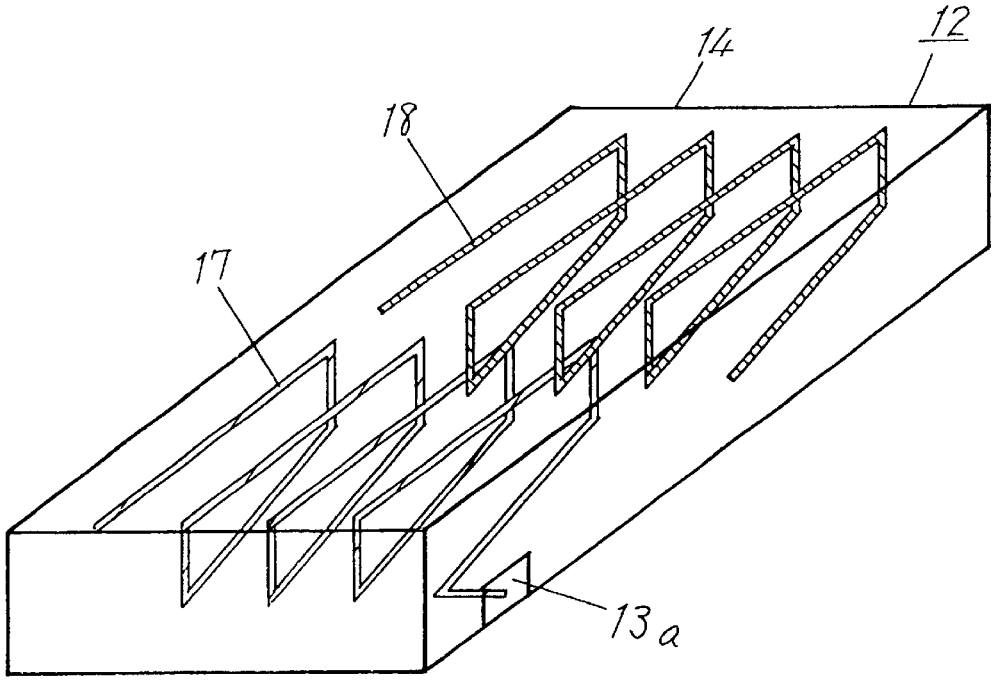
FIG. 16 is a perspective view showing a still further modification of the antenna according to the same embodiment.

More specifically, FIG. 15 shows the helical axis of first helical element 17 and the helical axis of second helical element 18 both arranged substantially in parallel with the longitudinal direction of dielectric substrate 14. FIG. 16 shows both elements arranged substantially orthogonal to the longitudinal direction.

Figure 17:
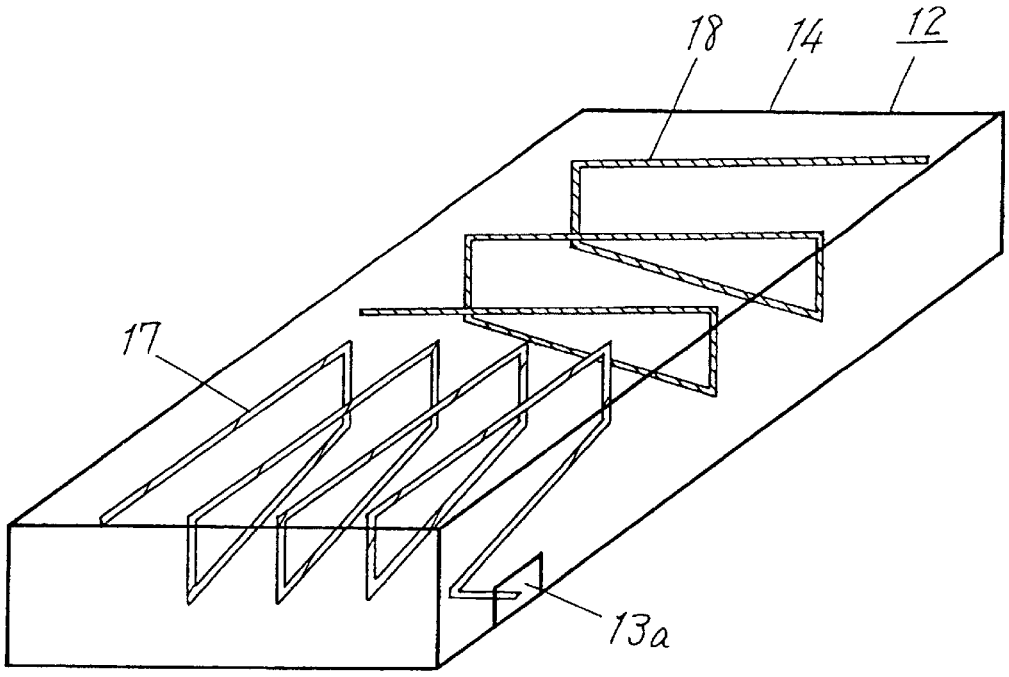
FIG. 17 is a perspective view showing a still further modification of the antenna according to the same embodiment.
Figure 18:
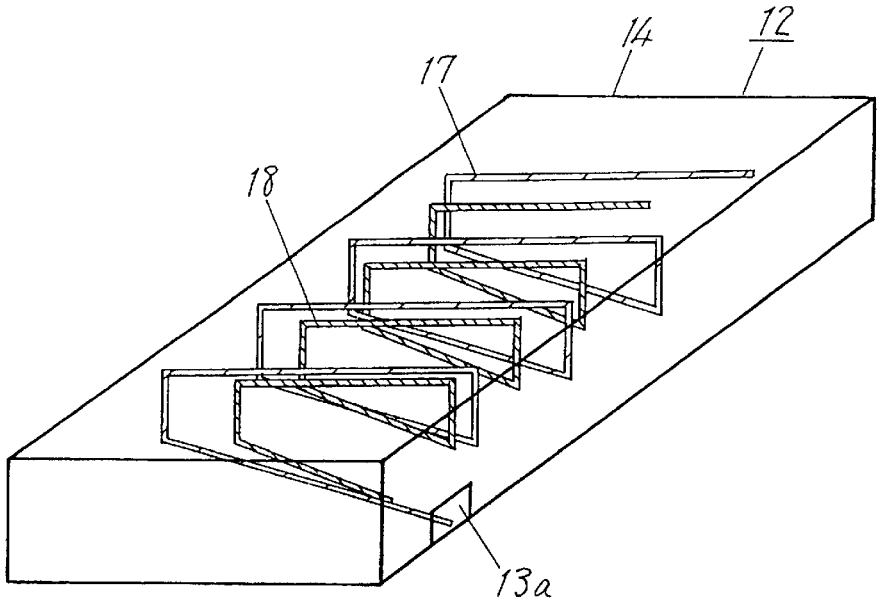
FIGS. 18(*a*) and 18(*b*) are a perspective view and a cross sectional view showing a still further modification of the antenna according to the same embodiment.
Figure 18:
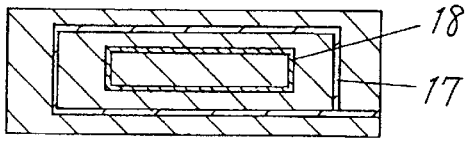

FIG. 17 shows that the helical axis of first helical element 17 is arranged substantially orthogonal to the longitudinal direction of dielectric substrate 14, and the helical axis of second helical element 18 is arranged substantially in parallel with the longitudinal direction. FIG. 18 shows that helical element 18 disposed along the center of the helical shape of helical element 17 while two elements 17 and 18 are shaped as shown in FIG. 15.

The antennas shown in FIG. 19 through 22 commonly comprise first radiation conductive element 19 and second radiation conductive element 20 both arranged of a meander shape, where only first radiation conductive element 19 is connected to power supply terminal 13*a* for feeding a high-frequency signal. Those differ from each other in the relationship between positions of first radiation conductive element 19 and second radiation conductive element 20.

Figure 19:
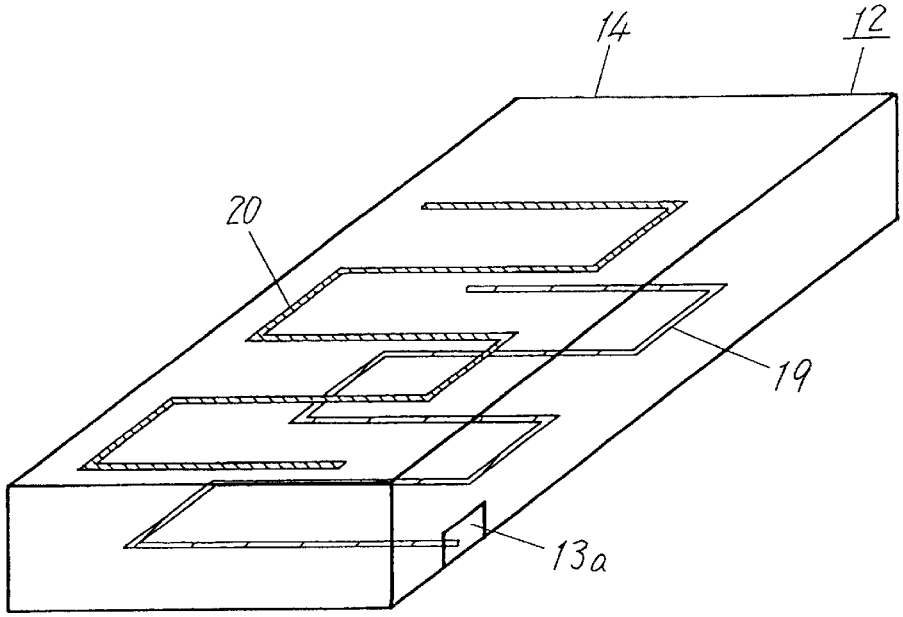
FIGS. 19(*a*) and 19(*b*) are a perspective view and a cross sectional view showing a still further modification of the antenna according to the same embodiment.
Figure 19:
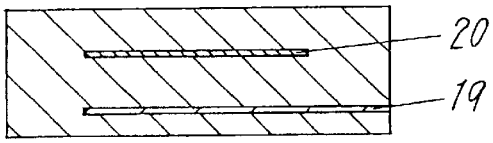
Figure 20:
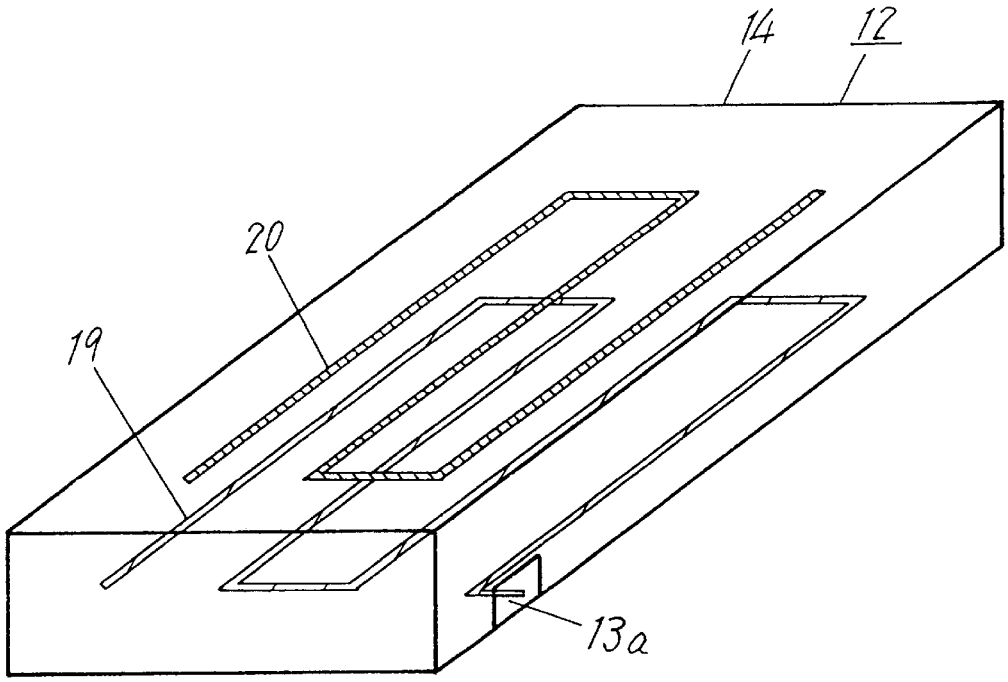
FIG. 20 is a perspective view showing a still further modification of the antenna according to the same embodiment.

More specifically, FIG. 19 shows the zigzag directions of first meander element 19 and second meander element 20 both arranged substantially in parallel with the longitudinal direction of dielectric substrate 14. FIG. 20 shows the elements are arranged substantially orthogonal to the longitudinal direction.

Figure 21:
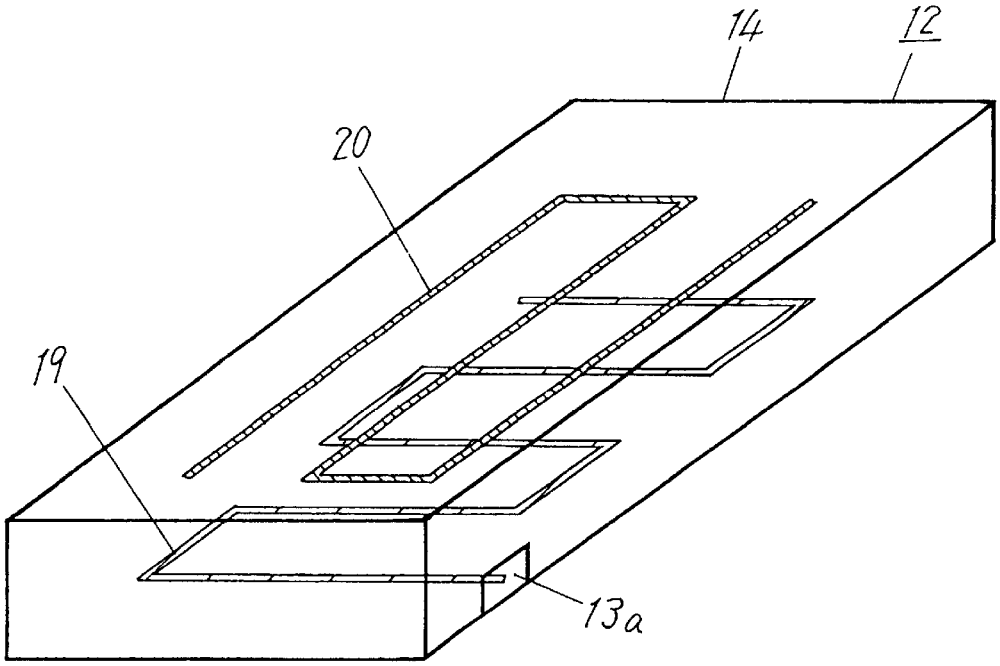
FIG. 21 is a perspective view showing a still further modification of the antenna according to the same embodiment.
Figure 22:
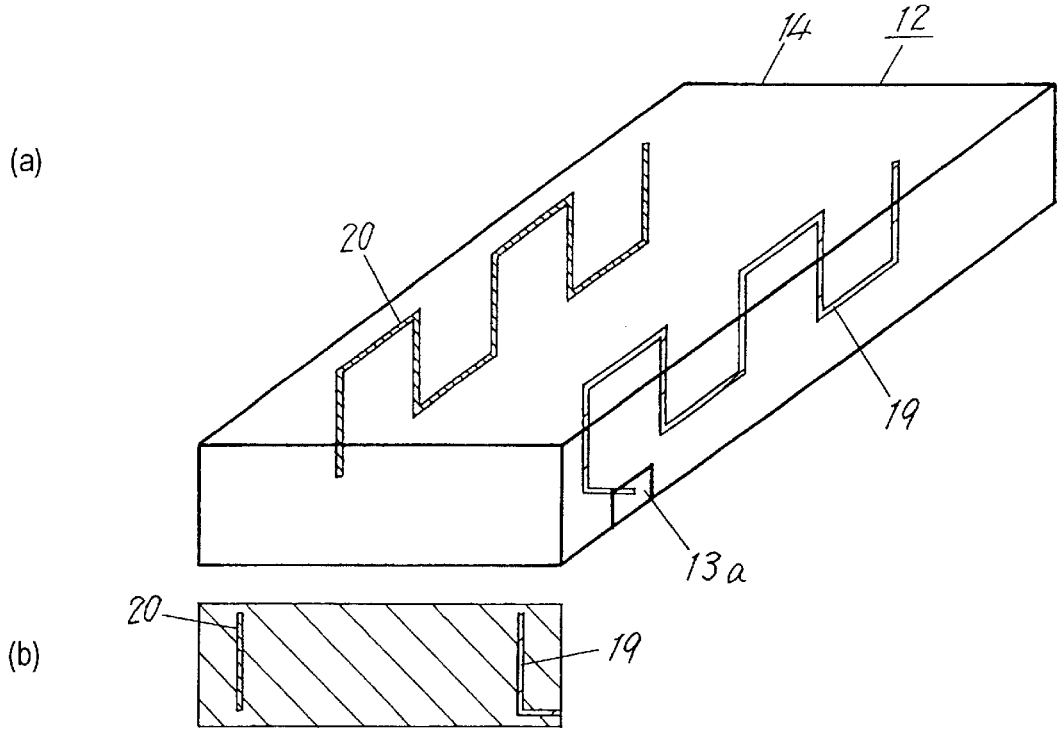
FIGS. 22(*a*) and 22(*b*) are a perspective view and a cross sectional view showing a still further modification of the antenna according to the same embodiment.

FIG. 21 shows that the zigzag direction of first meander element 19 is arranged substantially in parallel with the longitudinal direction of dielectric substrate 14, and the zigzag direction of second meander element 20 is arranged substantially orthogonal to the longitudinal direction. FIG. 22 shows two meander elements 19 and 20 disposed orthogonal to the bottom of dielectric substrate 14 while two elements 19 and 20 are shaped as shown in FIG. 19.

The antennas shown in FIGS. 23 through 28 commonly comprise first radiation-conductive element 21 formed of a zigzag, meander shape connected to power supply terminal 13*a* for feeding a high-frequency signal and second radiation-conductive element 22 is formed of a helical shape. Those differ from each other in the relationship between positions of first radiation-conductive element 21 and second radiation-conductive element 22.

Figure 23:
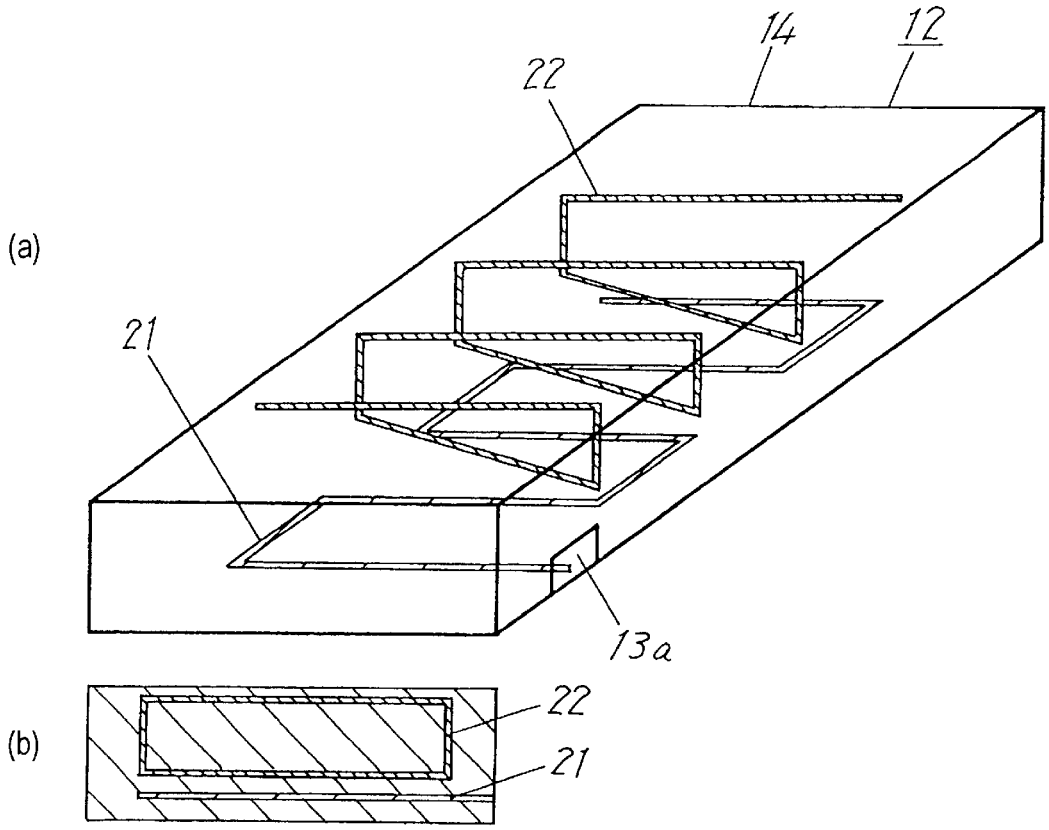
FIGS. 23(*a*) and 23(*b*) are a perspective view and a cross sectional view showing a still further modification of the antenna according to the same embodiment.
Figure 24:
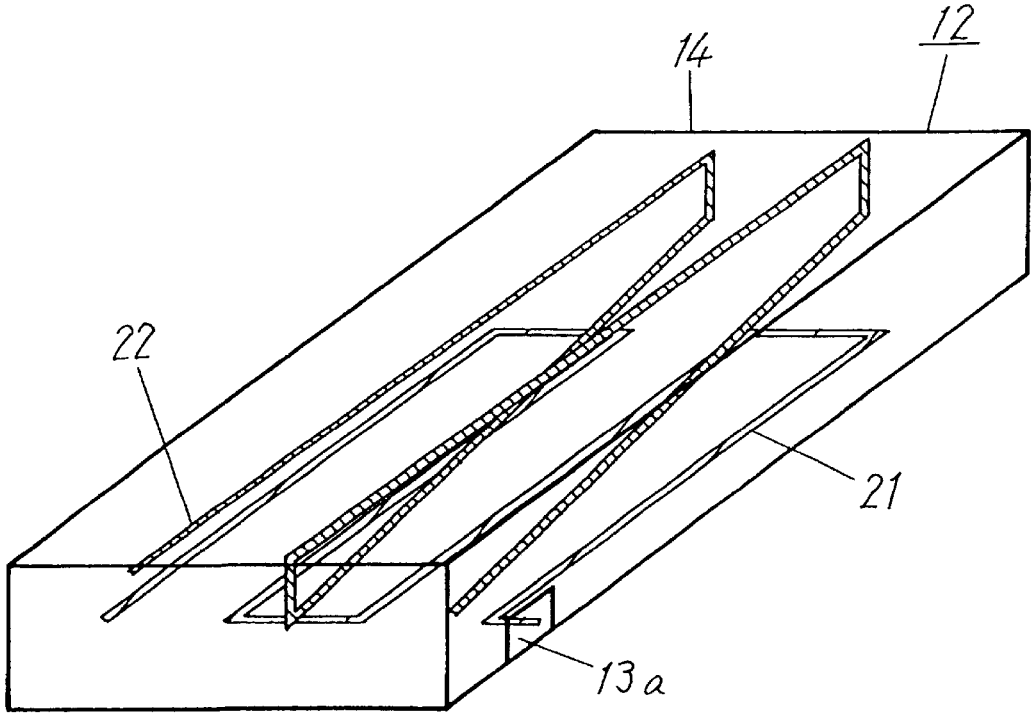
FIG. 24 is a perspective view showing a still further modification of the antenna according to the same embodiment.

More specifically, FIG. 23 shows the zigzag direction of meander element 21 and the helical axis of helical element 22 both arranged substantially in parallel with the longitudinal direction of dielectric substrate 14. FIG. 24, like FIG. 9, shows both arranged substantially in orthogonal to the longitudinal direction.

FIGS. 23 and 24 where power supply terminal 13*a* is connected to meander element 21 differs from FIGS. 9 and 10 where power supply terminal 13*a* is connected to helical element 15.

Figure 25:
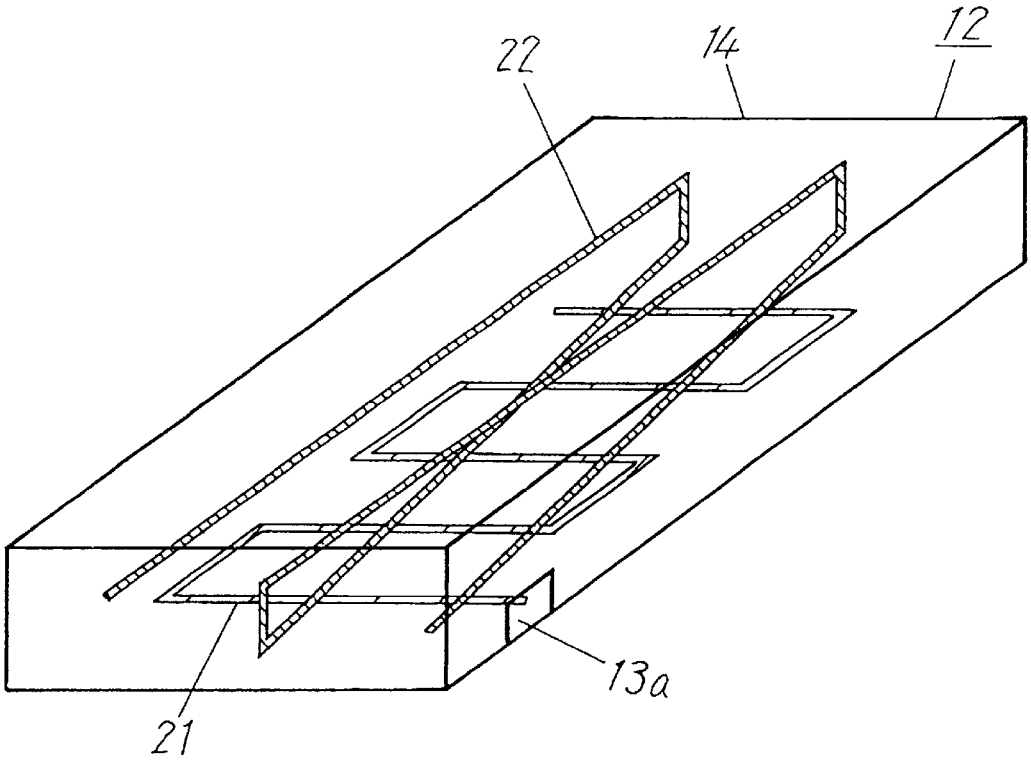
FIG. 25 is a perspective view showing a still further modification of the antenna according to the same embodiment.
Figure 26:
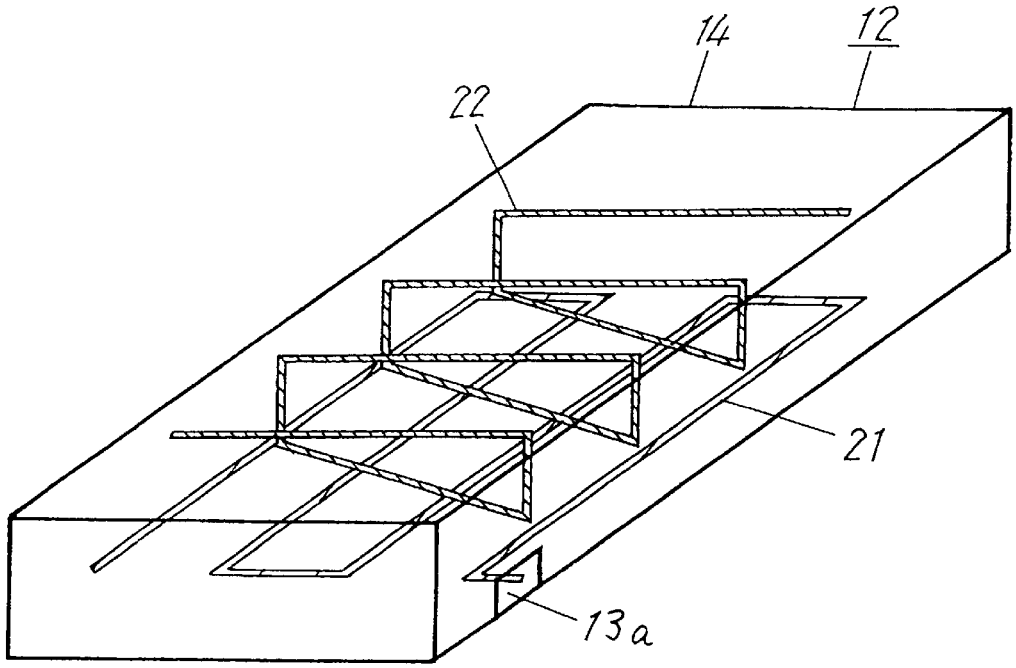
FIG. 26 is a perspective view showing a still further modification of the antenna according to the same embodiment.

FIG. 25 shows that the zigzag direction of meander element 21 is arranged substantially in parallel with the longitudinal direction of dielectric substrate 14, and the helical axis of helical element 22 is arranged substantially in orthogonal to the longitudinal direction. FIG. 26, in reverse to that, shows that the zigzag direction of meander element 21 is arranged substantially in orthogonal to the longitudinal direction of dielectric substrate 14, and the helical axis of helical element 22 is arranged substantially in parallel with the longitudinal direction FIGS. 25 and 26 where power supply terminal 13*a* is connected to meander element 21 differs from FIGS. 11 and 12 where power supply terminal 13*a* is connected to helical element 15.

Figure 27:
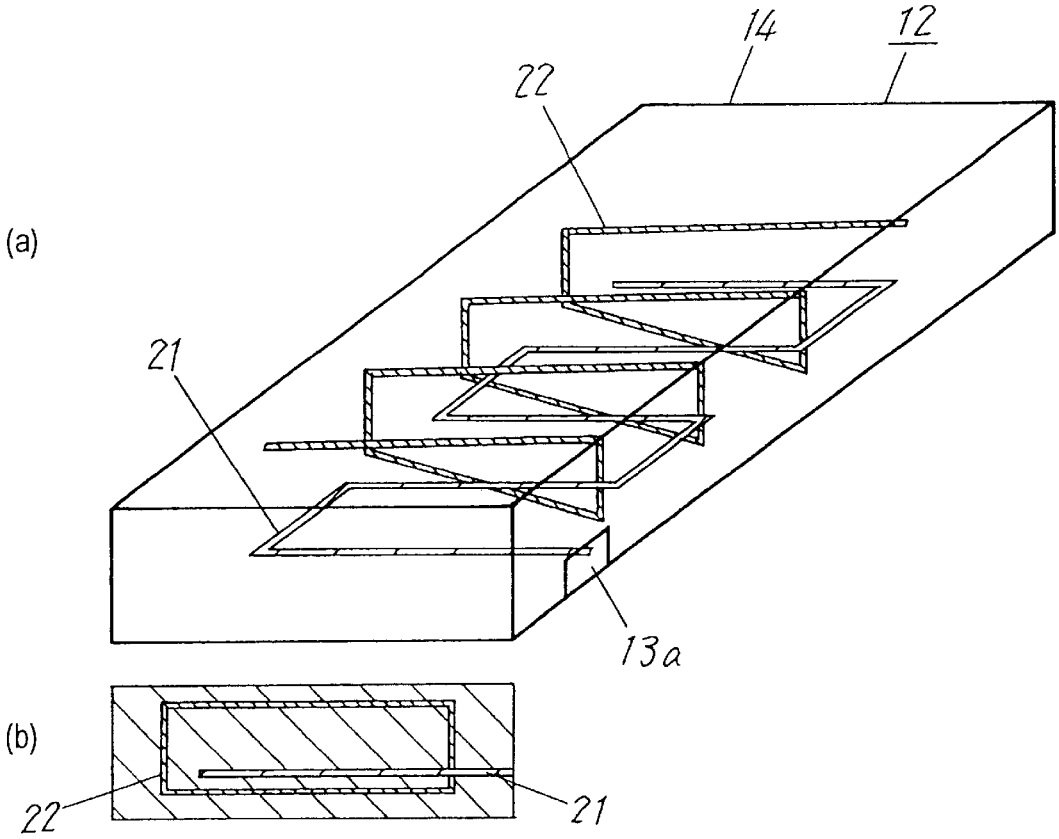
FIGS. 27(*a*) and 27(*b*) are a perspective view and a cross sectional view showing a still further modification of the antenna according to the same embodiment.
Figure 28:
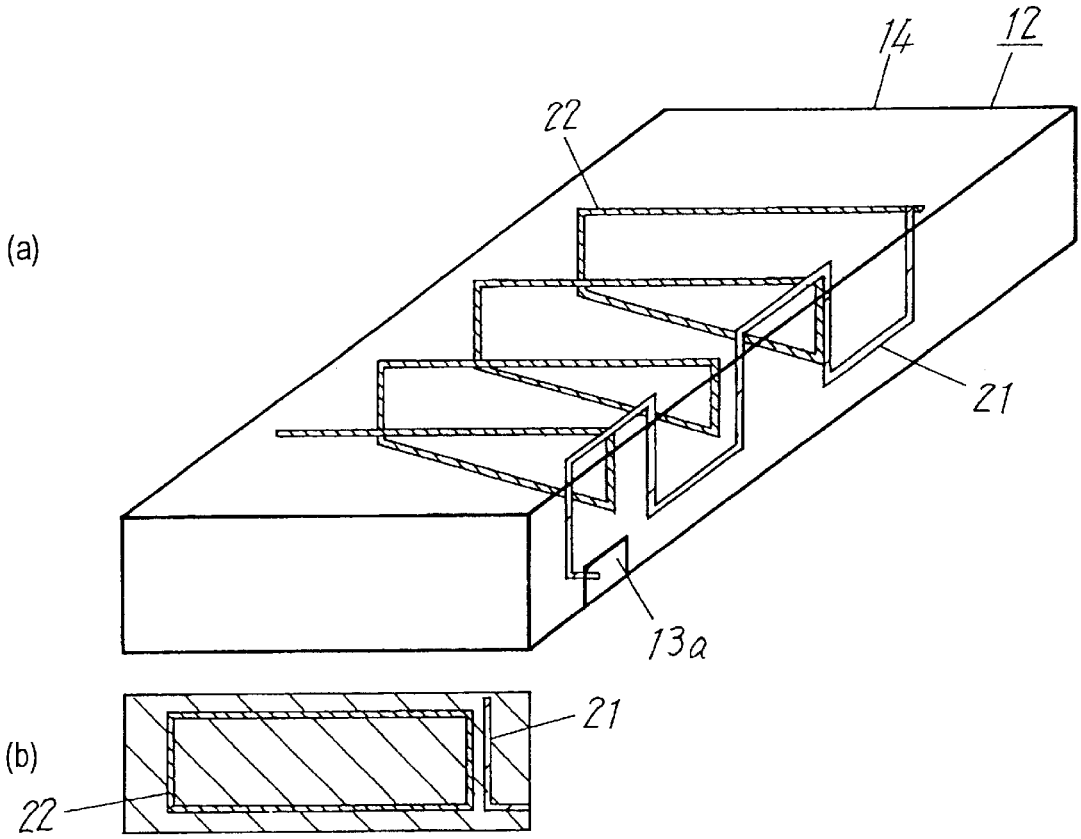
FIGS. 28(*a*) and 28(*b*) are a perspective view and a cross sectional view showing a still further modification of the antenna according to the same embodiment.

FIG. 27 illustrates meander element 21 disposed in helical element 22 while elements 21 and 22 are disposed as shown in FIG. 23. FIG. 28 illustrates meander element 21 disposed on the side of helical element 22 in the same construction. (Embodiment 3)

The installation of antenna 12 shown in FIG. 1 will be specifically described referring to FIGS. 29 through 34. The installation of the antenna operable to transmit and receive signals in two different frequency bands, respectively, but is not limited to that. Throughout the drawings, like components are denoted by like numerals, and their description will not be repeated.

Figure 29:
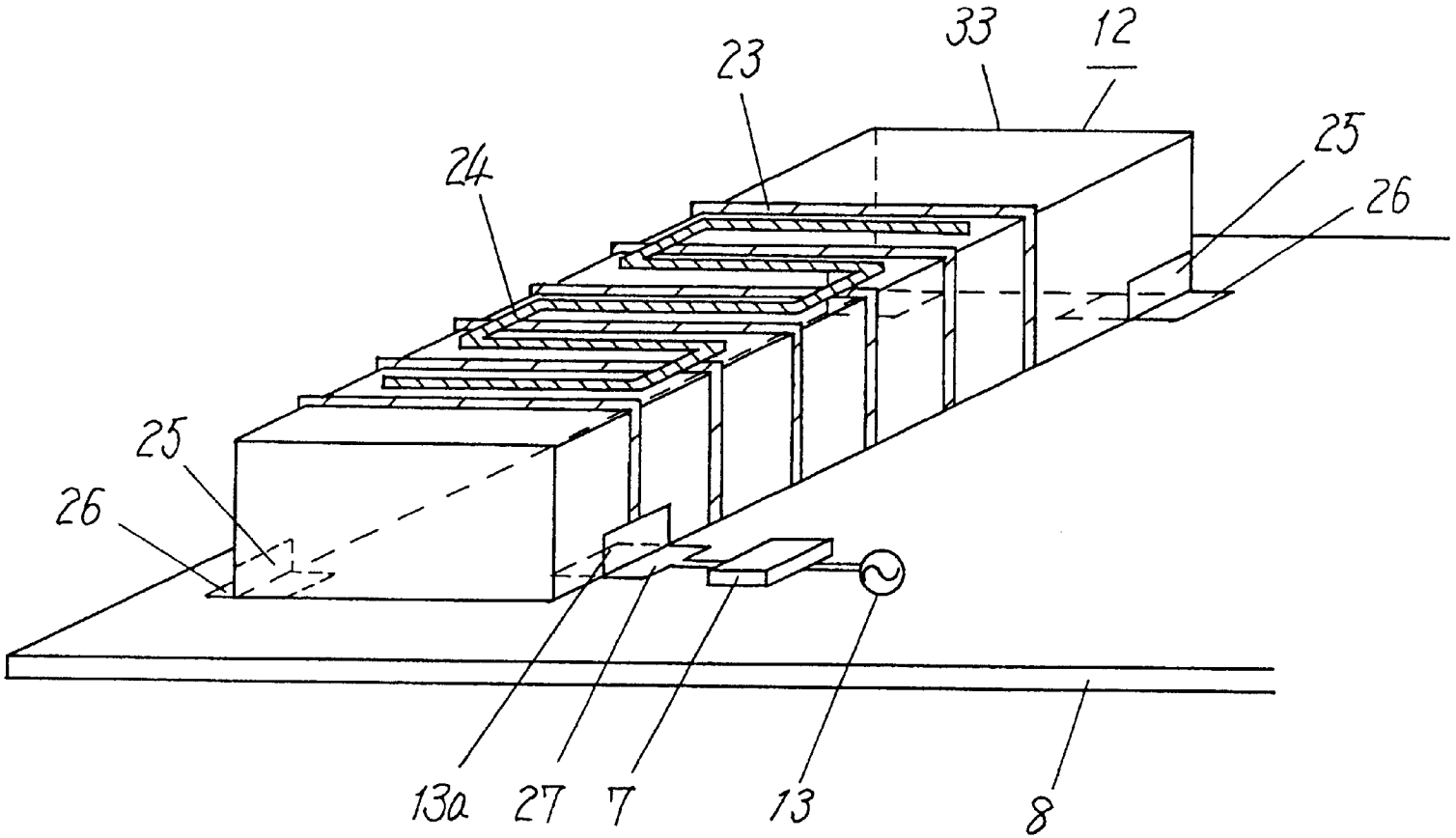
FIG. 29 is a perspective view of an installed antenna according to Embodiment 3 of the present invention.

In FIG. 29, reference numeral 12 denotes an antenna. In the antenna, first radiation-conductive element 23 is formed of a helical shape on the surface of core member 33 made of dielectric material, magnetic material, or insulating resin material, and second radiation-conductive element 24 is formed of a zigzag meander shape insulated from first radiation-conductive element 23.

Also, only first radiation conductive element 23 is connected to power supply terminal 13*a* for feeding a high-frequency signal. Matching circuit 14 is connected between power supply terminal 13*a* and power supply 13. Matching circuit 14 may comprise chip capacitors, chip inductors, or reactance elements, e.g. a circuit pattern on printed circuit board 8. Matching antenna 12 with power supply 13 reduces the power loss of reflections.

Core member 33 made of a dielectric material shortens its electrical length due to a wavelength-shortening effect on the dielectric material thus contributing to the smaller size of antenna 12. Antenna 12 having core member 33 made of magnetic material, antenna 12 is favorable for low-frequency signals.

In case that core member 33 is made of an insulating resin material, antenna 12 may be fabricated at higher efficiency. First radiation conductive-element 23 and second radiation-conductive element 24 are placed in advance at such locations as to realize a desired antenna characteristic and are encapsulated with the resin material by mold forming. First and second radiation-conductive elements 23, 24 may be shaped by pressing process. The whole manufacturing process can accordingly be easily automated with high productivity.

The relationship between positions of first radiation-conductive element 23 and second radiation-conductive element 24 may be modified for controlling the strength of electromagnetic coupling. This facilitates to adjust the impedance in the respective frequency band. Also, the antenna construction according to this embodiment is favorable for modifying the relationship between positions of the first and second radiation conductive elements.

The installation of antenna 12 will now be explained. Antenna 12 comprises three mounting terminals 25 formed on the bottom and sides thereof for being easily mounted on printed circuit board 8. Power supply terminal 13*a* is also formed over the bottom and a side of antenna 12. On the other hand, on printed circuit board, mounting lands 26 and power supply land 27 are formed on the corresponding four locations. Antenna 12 is securely soldered at the four locations, together with other components, to printed circuit board 8 by an automatic mounting technique.

Figure 30:
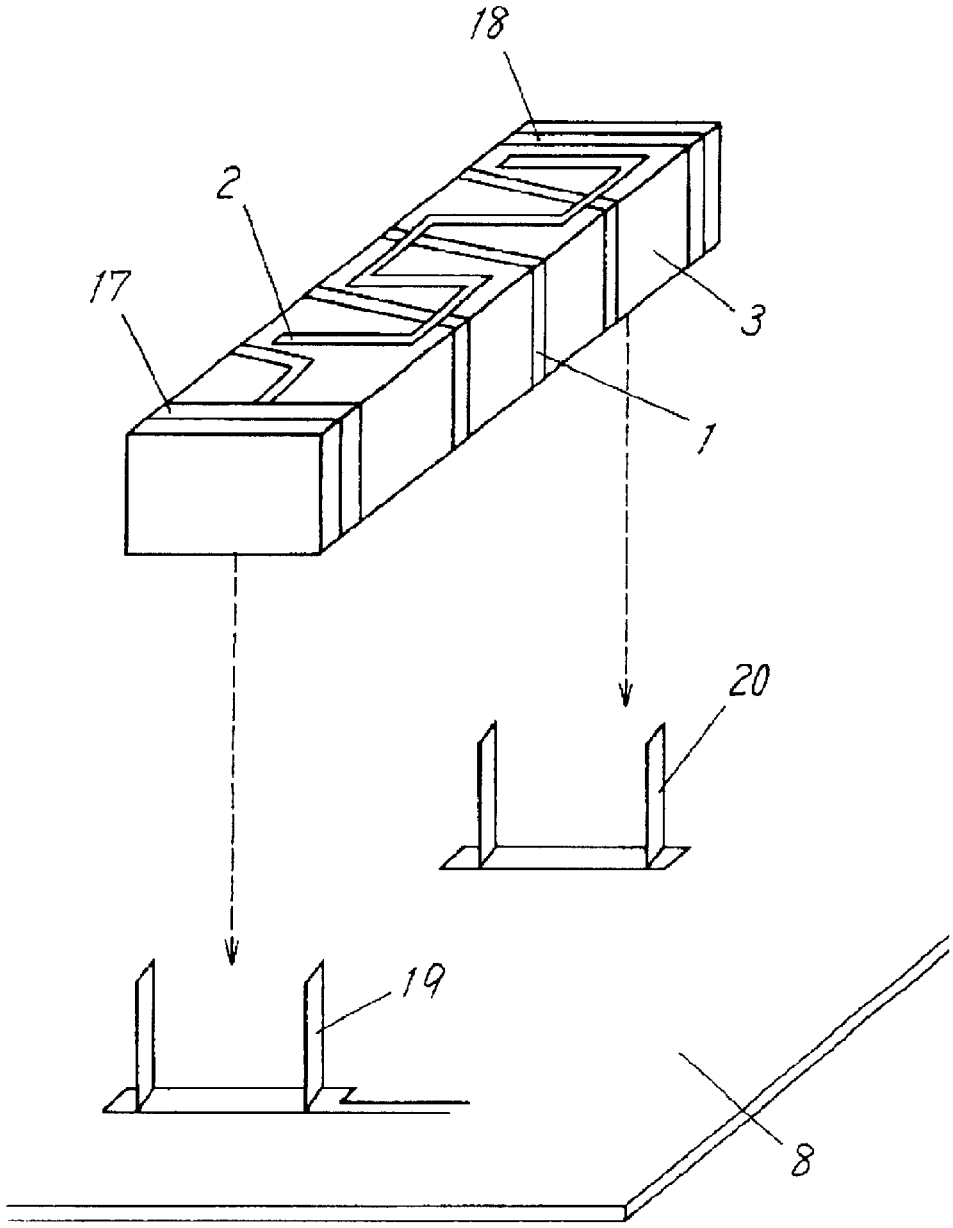
FIG. 30 is a perspective view showing a modification of the installed antenna according to the same embodiment.

FIG. 30 is a perspective view explaining a modification of the antenna installation. As shown, power supply terminal 28*a* connected to first radiation-conductive element 23 is formed on one end of core member 33, and mounting terminal 29*a* is formed on the other end. Power supply jig 28*b* and mounting jig 29*b* corresponding to the terminals, respectively, are provided on printed circuit board 8. The antenna is mounted8, power supply terminal 28*a* and mounting terminal 29*a* are put in and fixed to jigs 28*b* and 29*b*, respectively.

Consequently, antenna 12 is securely mounted by employing a simple arrangement, prevented from exposing to high temperatures in the reflow process, and thus, made of low fusing point material. And its characteristic is thus hardly declined.

Figure 31:
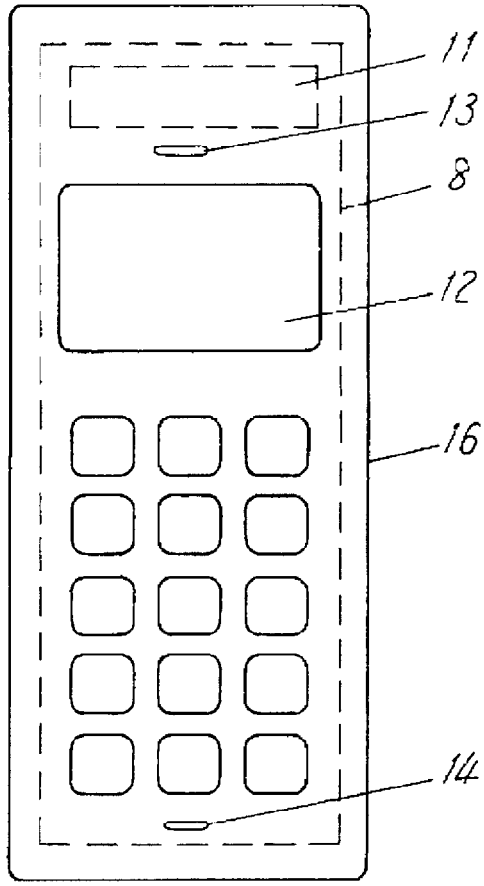
FIGS. 31(*a*) and 31(*b*) are a schematic view and a partial cross sectional view showing the antenna installed into a portable telephone according to the same embodiment.
Figure 31:
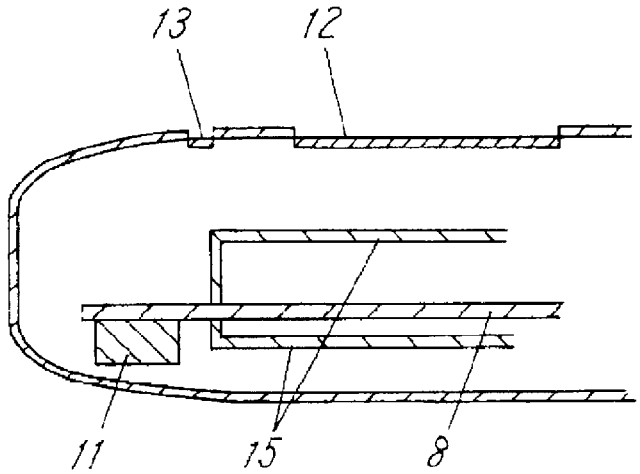
Figure 32:
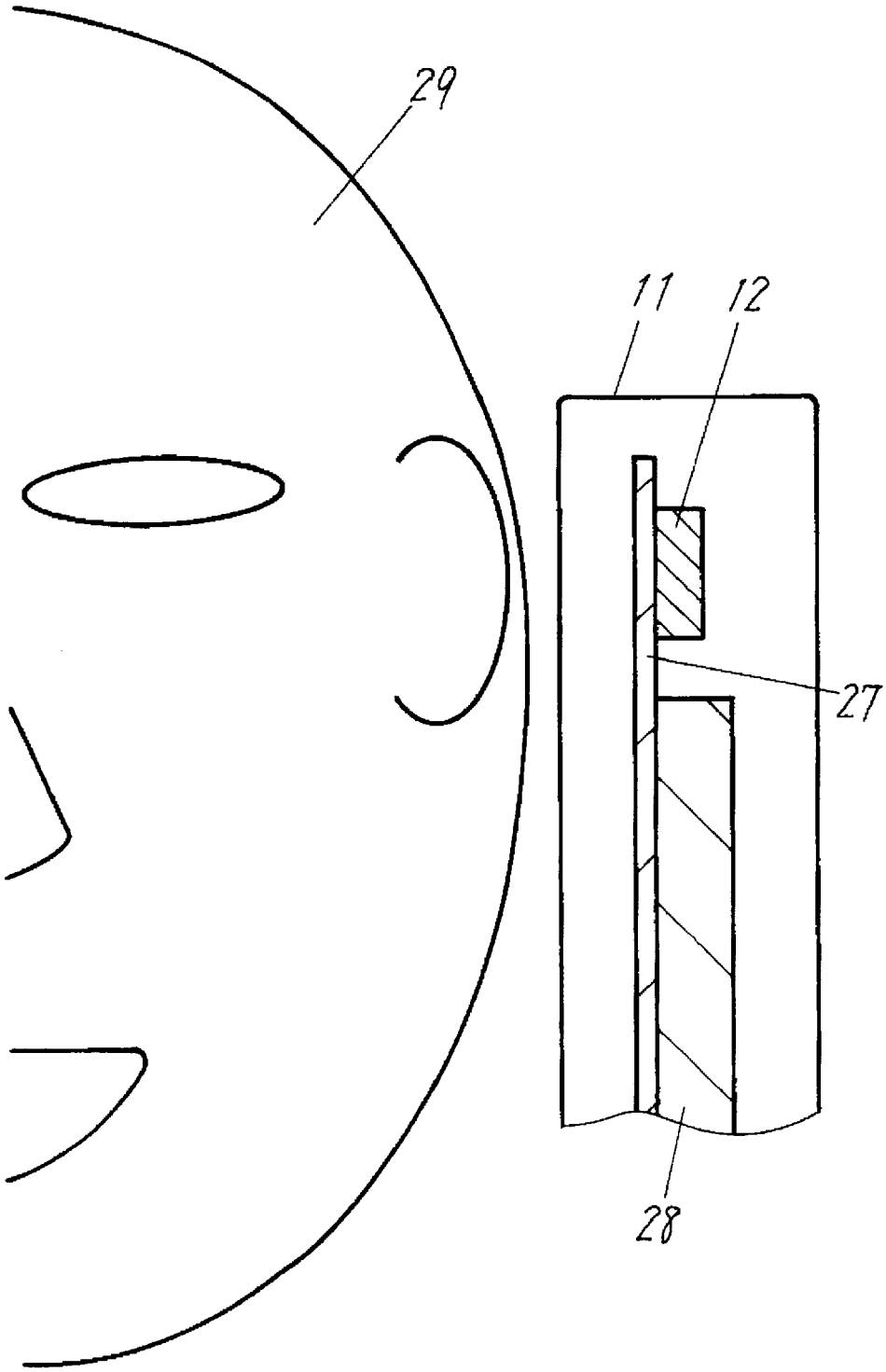
FIG. 32 is a schematic view of the portable telephone in use according to the same embodiment.

FIG. 31 illustrates a schematic plan view and a partially cross sectional view of a portable telephone to which the antenna is installed. FIG. 32 is a schematic view illustrating an example of the actual use of the portable telephone.

As shown, antenna 12 is mounted at the upper end on printed circuit board 8 embedded in case 11 of portable telephone 10. More specifically, antenna 12 is mounted on the opposite side to speaker 4 of printed circuit board 8 so that the antenna is distanced from head 6 of the user as much as possible when speaker 4 is put to the ear during his/her talking.

This reduces the power loss caused by the influence of head 6 and thus maintains the antenna radiation characteristics. This also reduces an unfavorable influence by holding case 11 with a hand.

Antenna 12 can locate far from an interruptive object, e.g. shield cover 9 for electrically shielding a high-frequency circuit or grounding patterns formed on printed circuit board 8. This reduces an electrical coupling with the object, the power loss caused by the electrical coupling, and thus declination of the antenna characteristics.

Figure 33:
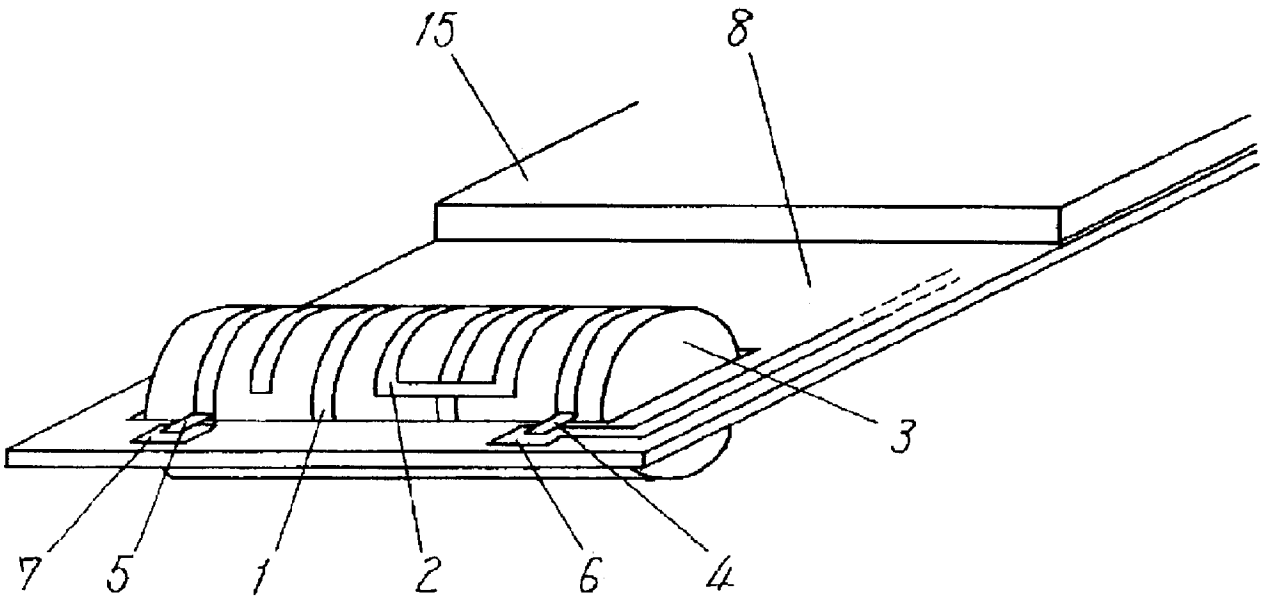
FIG. 33 is a perspective view showing a further modification of the installed antenna according to the same embodiment.

FIG. 33 is a perspective view illustrating another modification of the antenna installation. As shown, power supply terminal 34 connected to first radiation-conductive material 31 is formed on one end of the surface of core member 33 having a round shape in cross section thereof, and mounting terminal 37 is formed on the other end. Each terminal is designed so as to hold printed circuit board 8. Printed circuit board 8 has an opening formed therein operable to accommodate antenna 12. Power supply lands 36 and mounting lands 37 corresponding respectively to power supply terminal 34 and mounting terminal 35 are formed on both sides of printed circuit board 8. Power supply terminal 34 and mounting terminal 35 are soldered to their corresponding lands 36 and 37 so that antenna 12 can be securely fixed to printed circuit board 8.

For accommodating antenna 12, the opening formed in printed circuit board 8 according to this embodiment may be replaced by a notch of the same size provided in the upper end of printed circuit board 8. Also, the mounting terminal and the mounting land are not limited to one pair but two or more pairs so as to fix the antenna more securely.

Figure 34:
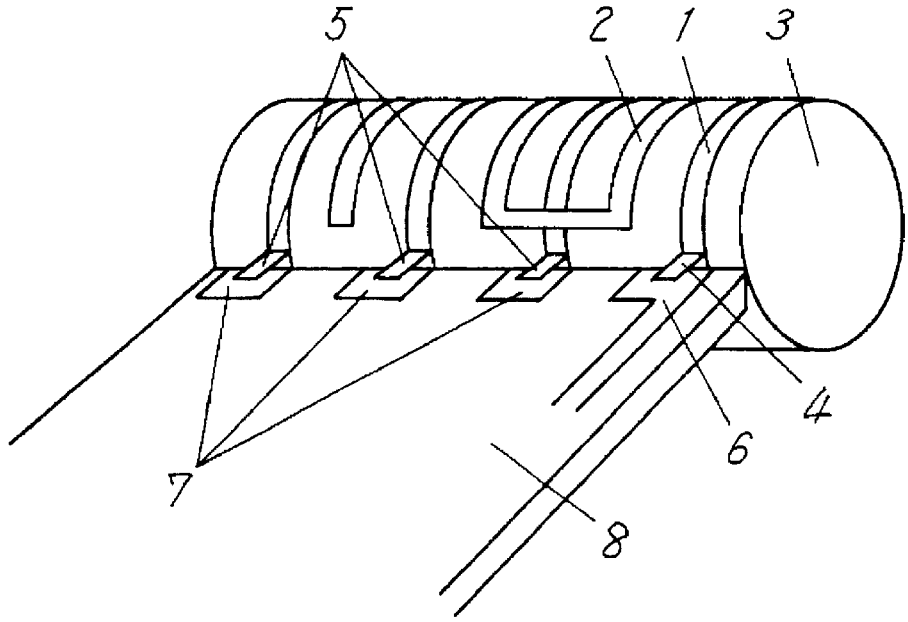
FIGS. 34(*a*) and 34(*b*) are a perspective view and a partial cross sectional view showing a further modification of the installed antenna installation according to the same embodiment.
Figure 34:
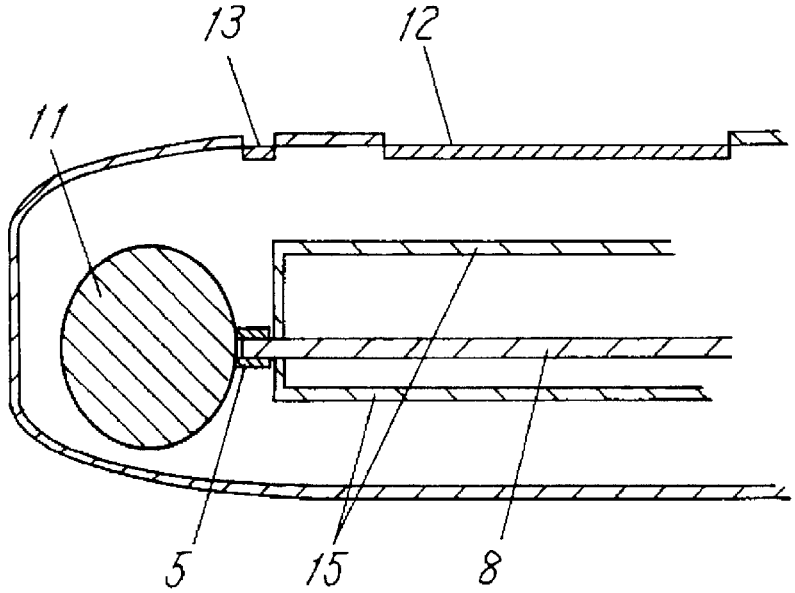

FIG. 34 is a perspective view showing a further modification of the antenna installation. As shown, power supply terminal 34 connected to first radiation-conductive material 31 is provided on one end region of the surface of core member 33 having a round shape in cross section thereof, and three mounting terminals 35 are provided on the remaining region with an equal interval. Each terminal is designed so as to hold printed circuit board 8. Power supply lands 36 and mounting lands 37 corresponding to power supply terminal 34 and mounting terminals 35 respectively are provided on both sides of printed circuit board 8. Power supply terminal 34 and mounting terminals 35 are soldered to corresponding lands 36 and 37 so as to fix the antenna to printed circuit board 8 securely.

The arrangements shown in FIGS. 33 and 34 permit the space in upper portion of case 11 to be used effectively, and the antenna characteristic is improved.

(Embodiment 4)

Specific constructions of antenna 12 shown in FIG. 1 will be described referring to FIGS. 35 through 39. The antenna is operable to transmit and receive signals in two different frequency bands, respectively, but is not limited to that. Throughout the drawings, like components are denoted by like numerals, and their description will not be repeated.

Figure 35:
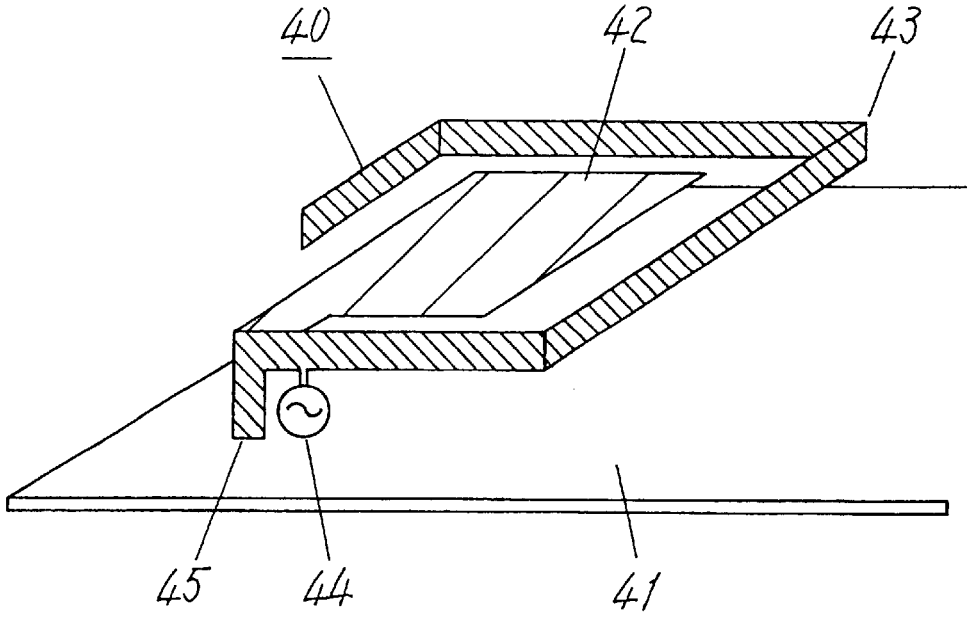
FIG. 35 is a perspective view of an antenna according to Embodiment 4 of the present invention.

In FIG. 35, reference numeral 40 denotes an inverted-F shaped antenna. Reference numeral 41 denotes a grounding substrate having a metal material provided at least on the surface thereof. Reference numeral 42 denotes a first radiation-conductive element arranged in parallel with and electrically connected to grounding substrate 41. Reference numeral 43 denotes a second radiation-conductive element arranged in vertical to grounding substrate 41 and electrically connected to first radiation-conductive element 42. Reference numeral 44 denotes a power supply feeding the radiation conductive-element with a high-frequency signal. And reference numeral 45 denotes a short-circuit element for connecting inverted-F shaped antenna 40 to grounding substrate 41.

Figure 36:
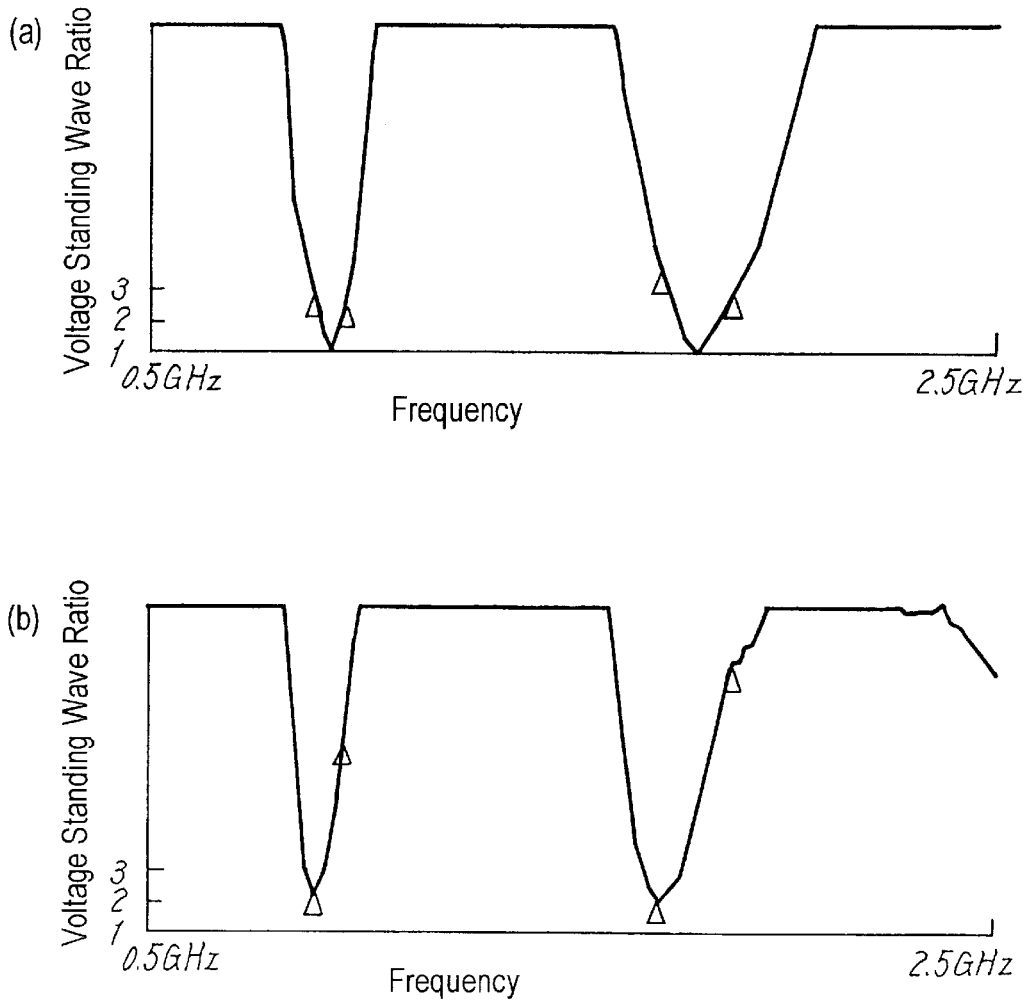
FIG. 36(*a*) is an impedance characteristic of the antenna according to the same embodiment, and FIG. 36(*b*) is an impedance characteristic of the conventional antenna shown in FIG. 39.
Figure 39:
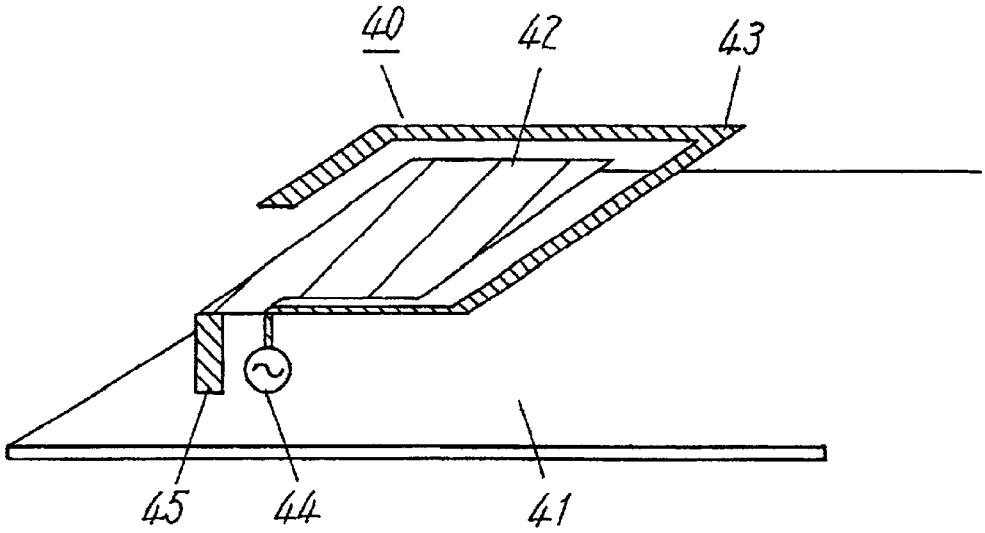
FIG. 39 is a perspective view of a conventional antenna.

FIG. 36(*a*) illustrates an impedance profile of the inverted-F shaped antenna, and FIG. 36(*b*) illustrates an impedance profile of a conventional inverted-F shaped antenna shown in FIG. 39. As compared, the profile of the inverted-F shaped antenna according to this embodiment exhibits a wider range of frequencies. The wider frequency range results because second radiation-conductive element 43 arranged substantially in vertical to grounding substrate 41 makes an impedance matching easier.

As second radiation-conductive element 43 is arranged substantially in vertical to grounding substrate 41, the overall area can be decreased. That reduces accordingly the interference with the antenna of the hand of a user, holding the telephone.

Figure 37:
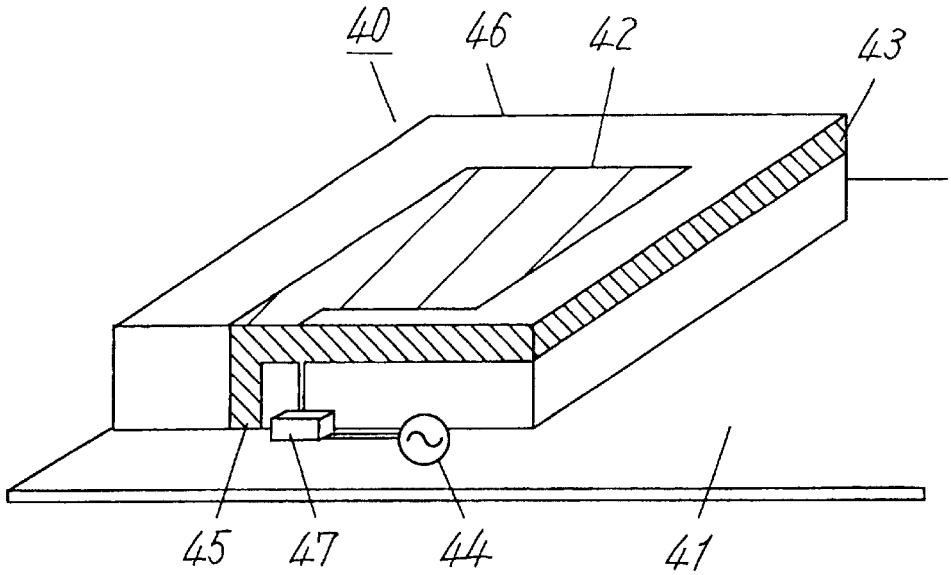
FIG. 37 is a perspective view showing another modification of the antenna according to the same embodiment.

FIG. 37 illustrates a modification of the inverted-F shaped antenna according to this embodiment. Reference numeral 46 denotes a dielectric body, where first and second radiation-conductive elements 42, 43 are formed on the surface of dielectric body 46 and coupled to power supply 44 through matching circuit 47 consisting of at least one reactance device.

This antenna becomes smaller because of the wavelength-shortening effect of dielectric body 46. As matching circuit 47 connected to power supply 44 ensures impedance matching, the antenna frequency range successfully increases. Matching circuit 47 may be implemented by chip components or a printed circuit pattern.

First and second radiation-conductive elements 42, 43 are not limited to be deposed on the surfaces of dielectric body 46 but may be embedded in dielectric body 46 with the same effect. Also, dielectric body 46 may be replaced by a magnetic body.

Figure 38:
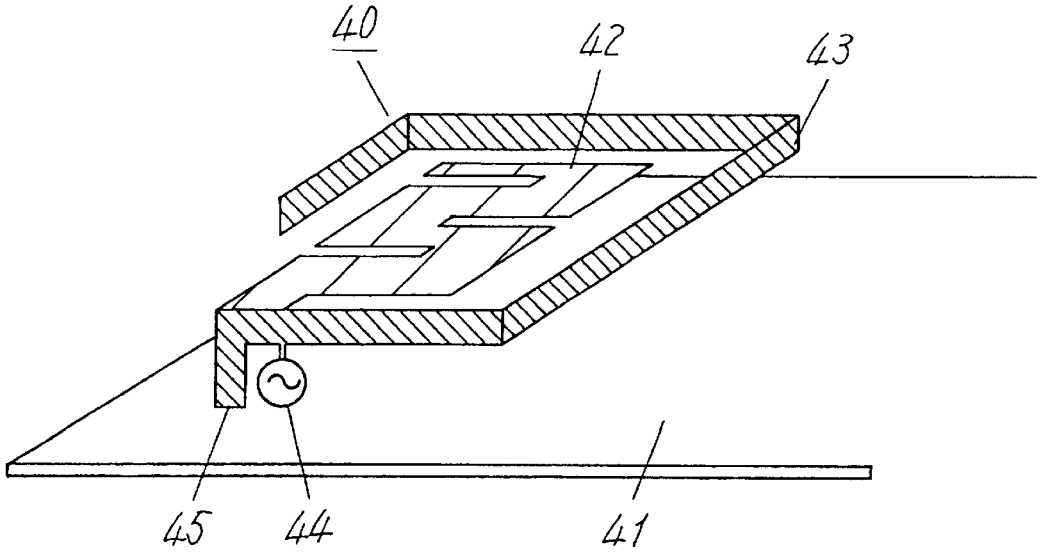
FIG. 38 is a perspective view showing a further modification of the antenna according to the same embodiment.

FIG. 38 illustrates another modification of the inverted-F shaped antenna having first radiation-conductive element 42 having a meander shape. The meander shape of first radiation-conductive element 42 lowers the resonance frequency, hence contributing to reduce the size of antenna 40.

While first radiation-conductive element 42 arranged in parallel with grounding substrate 41 is formed a meander shape in this modification, second radiation-conductive element 43 arranged vertical to grounding substrate 41 or both the radiation-conductive elements may be formed of a meander shape.

INDUSTRIAL APPLICABILITY

As set forth above, the antenna according to the present invention is mounted in substantially vertical to the longitudinal direction of a case of a mobile telecommunication apparatus, thus eliminating an undesired projecting portion on the case. This improves the portability of the mobile telecommunication apparatus, and minimizes its broken-down at any accident such as dropping down. Also, this allows the antenna to function for not only vertically polarized waves but also horizontally polarized waves to the case hence minimizing a declination in the antenna characteristic. Moreover, the antenna can be reduced to a chip size thus improving its mass-productivity and the electrical characteristics.

What is claimed is:

1. A mobile telecommunication antenna embedded in a case of a telecommunication apparatus comprising a high-frequency circuit in use operable in a plurality of different frequency bands comprising:

a first radiation-conductive element and a second radiation-conductive element both arranged substantially in vertical to a longitudinal direction of the case and located at an upper region in the case; and a power supply terminal electrically coupling a first end of the first radiation-conductive element to the high-frequency circuit embedded in the case, wherein the first and second radiation-conductive elements are electrically insulated from each other, and wherein a second end of the first radiation-conductive element and both ends of the second radiation-conductive element are opened.

2. The mobile telecommunication antenna according to claim 1 further comprising a third radiation-conductive element arranged at an upper region in the case and electrically insulated from both the first and second radiation-conductive elements.

3. The mobile telecommunication antenna according to claim 1, wherein both the first and second radiation-conductive elements are formed by helical elements or zigzag meander elements.

4. The mobile telecommunication antenna according to claim 1, wherein the plurality of frequency bands include first and second frequency bands different from each other, and wherein said first and second radiation-conductive elements has lengths of 1/2 wavelengths of said first and second frequency bands, respectively.

5. The mobile telecommunication antenna according to claim 1 further comprising a dielectric substrate including the first and second radiation-conductive elements, wherein the first and second radiation-conductive elements are formed by one of a conductive pattern and a combination of a conductive pattern and a through-hole at least one of on a surface and an inside of the dielectric substrate.

6. The mobile telecommunication antenna according to claim 5, wherein the power supply terminal is formed on a surface of the dielectric substrate, and wherein the mobile telecommunication antenna is mounted by the power supply terminal on a surface of a printed circuit board where the high-frequency circuit is mounted thereon.

7. The mobile telecommunication antenna according to claim 1 further comprising a resin molded body accommodating the first and second radiation-conductive elements therein integrally by resin molding.

8. The mobile telecommunication antenna according to claim 7, wherein the power supply terminal is formed on the resin molded body, and wherein the mobile telecommunication antenna is mounted by the power supply terminal to a printed circuit board on which the high-frequency circuit is mounted.

9. The mobile telecommunication antenna according to claim 7, wherein the first and second radiation-conductive elements are formed by a pressing process.

10. The mobile telecommunication antenna according to claim 1, wherein the first and second radiation-conductive elements are formed by a helical element and a zigzag meander element, respectively, or the first and second radiation-conductive elements are formed by a zigzag meander element and a helical element, respectively.

11. The mobile telecommunication antenna according to claim 10 further comprising a dielectric substrate in which a helical axis of the helical element and a zigzag direction of the meander element are arranged substantially in parallel with the longitudinal direction of the dielectric substrate.

12. The mobile telecommunication antenna according to claim 10 wherein a helical axis of the helical element and a zigzag direction of the meander element are arranged substantially in orthogonal to a longitudinal direction of the case.

13. The mobile telecommunication antenna according to claim 10 further comprising a dielectric substrate in which a helical axis of the helical element is arranged substantially in parallel with a longitudinal direction of the dielectric substrate, and a zigzag direction of the meander element is arranged substantially in orthogonal to the longitudinal direction of the dielectric substrate.

14. The mobile telecommunication antenna according to claim 10 further comprising a dielectric substrate in which a helical axis of the helical element is arranged substantially in orthogonal to a longitudinal direction of the dielectric substrate, and a zigzag direction of the meander element is arranged substantially in parallel with the longitudinal direction of the dielectric substrate.

15. The mobile telecommunication antenna according to claim 10, wherein the meander element is located at an outside of the helical element.

16. The mobile telecommunication antenna according to claim 3 further comprising a dielectric substrate in which a helical axis of the two helical elements or a zigzag direction of the two meander elements are arranged substantially in parallel with a longitudinal direction of the dielectric substrate.

17. The mobile telecommunication antenna according to claim 16, wherein the helical axes of the two helical elements or the zigzag directions of the two meander elements are aligned in parallel or coaxial with each other.

18. The mobile telecommunication antenna according to claim 3 further comprising a dielectric substrate in which helical axes of the two helical elements or zigzag directions of the two meander elements are arranged substantially in orthogonal to a longitudinal direction of the dielectric substrate.

19. The mobile telecommunication antenna according to claim 18, wherein the helical axes of the two helical elements or the zigzag directions of the two meander elements are aligned in parallel or coaxial with each other.

20. The mobile telecommunication antenna according to claim 3, wherein a helical axis of one of the two helical elements is arranged different from a helical axis of other of the one of the two helical elements, or a zigzag direction of one of the two meander elements is arranged different from a zigzag direction of the other of the one of the two meander elements.

21. The mobile telecommunication antenna according to claim 3, wherein one of the two helical elements is located inside of other of the one of the two helical elements.

22. The mobile telecommunication antenna according to claim 3, wherein the two meander elements are arranged with or reversed from each other in zigzag patterns.

23. A mobile telecommunication apparatus operable in a plurality of different frequency bands comprising:

an operating unit;

a display;

a speaker;

a microphone;

a case;

a high-frequency circuit embedded in the case; and an antenna embedded in the case and disposed substantially in vertical to a longitudinal direction of the case, comprising:

a first radiation-conductive element and a second radiation-conductive element disposed at an upper region in the case; and a power supply terminal electrically coupling a first end of the first radiation conductive element to the high-frequency circuit, wherein the first and second radiation-conductive elements are electrically insulated from each other, and a second end of the first radiation-conductive element and both ends of the second radiation-conductive element are opened.

24. The mobile telecommunication apparatus according to claim 23, wherein the first and second radiation-conductive elements are formed by a helical element and a zigzag meander element, respectively, or the first and second radiation-conductive elements are formed by a zigzag meander element and a helical element, respectively.

25. The mobile telecommunication apparatus according to claim 23, wherein both the first and second radiation-conductive elements are formed by helical elements or zigzag meander elements.

26. The mobile telecommunication apparatus according to claim 23 further comprising a printed circuit board where the high-frequency circuit in mounted thereon, wherein the antenna is mounted at an upper end of the printed circuit board and projecting from both sides of the printed circuit board.

27. The mobile telecommunication apparatus according to claim 23, wherein the plurality of frequency bands include first and second frequency bands different from each other, and wherein said first and second radiation-conductive elements has lengths of 1/2 wavelengths of said first and second frequency bands, respectively.

28. The mobile telecommunication apparatus according to claim 23, wherein the antenna further comprises a resin molded body assembling the first and second radiation-conductive elements therein integrally by resin molding.

29. The mobile telecommunication apparatus according to claim 28 further comprising a printed circuit board where the high-frequency circuit is mounted, wherein the power supply terminal is formed on the resin molded body, and wherein the antenna is mounted by the power supply terminal to the printed circuit board.

30. The mobile telecommunication apparatus according to claim 28, wherein the first and second radiation-conductive elements are formed by a pressing process.

31. The mobile telecommunication apparatus according to claim 23, wherein the antenna further comprises a dielectric substrate where the first and second radiation-conductive elements are formed by one of a conductive pattern and a combination of a conductive pattern and a through-hole at least one of on a surface and an inside of the dielectric substrate.

32. The mobile telecommunication apparatus according to claim 31 further comprising a printed circuit board where the high-frequency circuit is mounted thereon, wherein the power supply terminal is formed on a surface of the dielectric substrate, and wherein the antenna is mounted by the power supply terminal on the printed circuit board.

33. The mobile telecommunication apparatus according to claim 23 further comprising a printed circuit board where the high-frequency circuit is mounted thereon, and a notch is formed in an upper end thereof for accommodating the antenna.

34. The mobile telecommunication apparatus according to claim 33, wherein the body is made of one of dielectric material and magnetic material accommodating the first and second radiation-conductive elements at least on a surface of the body and in the body.

35. A mobile telecommunication apparatus operable in first and second frequency bands different from each other, comprising:

a case having a longitudinal direction;

a high-frequency circuit accommodated in said case; and an antenna accommodated in an end portion of said case in said longitudinal direction, comprising:

a first radiation-conductive element having a first end thereof being open and extending substantially perpendicularly to said longitudinally direction;

a second radiation-conductive element having both ends being open and extending substantially perpendicularly to said longitudinally direction, the second radiation-conductive element being electrically insulated from the first radiation-conductive element; and a power supply terminal operable to send a signal to and to receive a signal from a second end of the first radiation-conductive element to said high-frequency circuit.

36. The mobile telecommunication apparatus according to claim 35, wherein said antenna further comprises a third radiation-conductive element electrically insulated from the first and second radiation-conductive elements.

37. The mobile telecommunication apparatus according to claim 35, wherein said antenna further comprises a resin molded body accommodating the first and second radiation-conductive elements therein integrally by resin molding.

38. The mobile telecommunication apparatus according to claim 37, wherein the first and second radiation-conductive elements and the resin molded body is fixed by resin molding.

39. The mobile telecommunication apparatus according to claim 38, wherein the power supply terminal is formed on the resin molded body.

40. The mobile telecommunication apparatus according to claim 35, wherein the first and second radiation-conductive elements are formed of metal by a pressing process.

41. The mobile telecommunication apparatus according to claim 35, wherein said antenna further comprises:

a dielectric substrate; and conductive foils for forming the first and second radiation-conductive elements, the conductive foils is provided in or on the dielectric substrate.

42. The mobile telecommunication apparatus according to claim 41, wherein the power supply terminal is formed on the dielectric substrate.

43. The mobile telecommunication apparatus according to claim 35, wherein the first and second radiation-conductive elements have helical shapes.

44. The mobile telecommunication apparatus according to claim 43, wherein the dielectric substrate has a rectangular shape, and wherein the helical shapes of the first and second radiation-conductive elements are arranged substantially in a longitudinal direction of the dielectric substrate.

45. The mobile telecommunication apparatus according to claim 43, wherein the dielectric substrate has a rectangular shape, and wherein the helical shapes of the first and second radiation-conductive elements are arranged substantially perpendicularly to a longitudinal direction of the dielectric substrate.

46. The mobile telecommunication apparatus according to claim 43, wherein the dielectric substrate has a rectangular shape, wherein the helical shape of the first radiation-conductive element is arranged substantially in a longitudinal direction of the dielectric substrate, and wherein the helical shape of the second radiation-conductive element is arranged substantially perpendicularly to the longitudinal direction of the dielectric substrate.

47. The mobile telecommunication apparatus according to claim 43, wherein the dielectric substrate has a rectangular shape, wherein the helical shape of the first radiation-conductive element is arranged substantially perpendicularly to a longitudinal direction of the dielectric substrate, and wherein the helical shape of the second radiation-conductive element is arranged substantially in the longitudinal direction of the dielectric substrate.

48. The mobile telecommunication apparatus according to claim 43, wherein one of the first and second radiation-conductive elements are arranged inside of other of the first and second radiation-conductive elements.

49. The mobile telecommunication apparatus according to claim 43, wherein the first and second radiation-elements are arranged in co-axial.

50. The mobile telecommunication apparatus according to claim 35, wherein the first and second radiation-elements have meander shapes.

51. The mobile telecommunication apparatus according to claim 50, wherein the dielectric substrate has a rectangular shape, and wherein the meander shapes of the first and second radiation-conductive elements are arranged substantially in a longitudinal direction of the dielectric substrate.

52. The mobile telecommunication apparatus according to claim 50, wherein the dielectric substrate has a rectangular shape, and wherein the meander shapes of the first and second radiation-conductive elements are arranged substantially perpendicularly to a longitudinal direction of the dielectric substrate.

53. The mobile telecommunication apparatus according to claim 50, wherein the dielectric substrate has a rectangular shape, wherein the meander shape of the first radiation-conductive element is arranged substantially in a longitudinal direction of the dielectric substrate, and wherein the meander shape of the second radiation-conductive element is arranged substantially perpendicularly to the longitudinal direction of the dielectric substrate.

54. The mobile telecommunication apparatus according to claim 50, wherein the dielectric substrate has a rectangular shape, wherein the meander shape of the first radiation-conductive element is arranged substantially perpendicularly to a longitudinal direction of the dielectric substrate, and wherein the meander shape of the second radiation-conductive element is arranged substantially in the longitudinal direction of the dielectric substrate.

55. The mobile telecommunication apparatus according to claim 50, wherein the two shapes of the first and second radiation-conductive elements are arranged symmetrically to each other.

56. The mobile telecommunication apparatus according to claim 50, wherein the meander shapes of the first and second radiation-conductive elements are arranged in parallel with each other.

57. The mobile telecommunication apparatus according to claim 35, wherein the first radiation-conductive element has a helical shape, and the second radiation-conductive element has a meander shape.

58. The mobile telecommunication apparatus according to claim 57, wherein the a dielectric substrate has a rectangular shape, and wherein the helical shape of the first radiation-conductive element and the meander shape of the second radiation-conductive element are arranged substantially in a longitudinal direction of the dielectric substrate.

59. The mobile telecommunication apparatus according to claim 57, wherein the a dielectric substrate has a rectangular shape, and wherein the helical shape of the first radiation-conductive element and the meander shape of the second radiation-conductive element are arranged substantially perpendicularly to a longitudinal direction of the dielectric substrate.

60. The mobile telecommunication apparatus according to claim 57, wherein the a dielectric substrate has a rectangular shape, wherein the helical shape of the first radiation-conductive element is arranged substantially in a longitudinal direction of the dielectric substrate, and wherein the meander shape of the second radiation-conductive element is arranged substantially perpendicularly to the longitudinal direction of the dielectric substrate.

61. The mobile telecommunication apparatus according to claim 57, wherein the a dielectric substrate has a rectangular shape, wherein the helical shape of the first radiation-conductive element is arranged substantially perpendicularly to a longitudinal direction of the dielectric substrate, and wherein the meander shape of the second radiation-conductive element is arranged substantially in the longitudinal direction of the dielectric substrate.

62. The mobile telecommunication apparatus according to claim 57, wherein the meander shape is located at an outside of the helical shape.

63. The mobile telecommunication apparatus according to claim 57, wherein the helical shape and the meander shape are arranged in directions different from each other.

64. The mobile telecommunication apparatus according to claim 35, wherein the first radiation-conductive element has a meander shape, and the second radiation-conductive element has a helical shape.

65. The mobile telecommunication apparatus according to claim 64, wherein the a dielectric substrate has a rectangular shape, and wherein the meander shape of the first radiation-conductive element and the helical shape of the second radiation-conductive element are arranged substantially in a longitudinal direction of the dielectric substrate.

66. The mobile telecommunication apparatus according to claim 64, wherein the a dielectric substrate has a rectangular shape, and wherein the meander shape of the first radiation-conductive element and the helical shape of the second radiation-conductive element are arranged substantially perpendicularly to a longitudinal direction of the dielectric substrate.

67. The mobile telecommunication apparatus according to claim 64, wherein the a dielectric substrate has a rectangular shape, wherein the meander shape of the first radiation-conductive element is arranged substantially in a longitudinal direction of the dielectric substrate, and wherein the helical shape of the second radiation-conductive element is arranged substantially perpendicularly to the longitudinal direction of the dielectric substrate.

68. The mobile telecommunication apparatus according to claim 64, wherein the a dielectric substrate has a rectangular shape, wherein the meander shape of the first radiation-conductive element is arranged substantially perpendicularly to a longitudinal direction of the dielectric substrate, and wherein the helical shape of the second radiation-conductive element is arranged substantially in the longitudinal direction of the dielectric substrate.

69. The mobile telecommunication apparatus according to claim 64, wherein the meander shape is located at an outside of the helical shape.

70. The mobile telecommunication apparatus according to claim 64, wherein the helical shape and the meander shape are arranged in directions different from each other.

71. The mobile telecommunication apparatus according to claim 35, further comprising:

a board having said high-frequency circuit mounted thereon, wherein said antenna further comprises a dielectric member folding the first and second radiation-conductive elements and having a longitudinal direction, and wherein said longitudinal direction is substantially perpendicular to said longitudinal direction of said case.

72. The mobile telecommunication apparatus according to claim 71, wherein the power supply terminal is formed on the dielectric member, and wherein the antenna is surface-mounted on the board via the power supply terminal.

73. The mobile telecommunication apparatus according to claim 71, wherein the board has a substantially-rectangular shape, wherein the board has a notch formed in a short side thereof, and wherein the antenna is inserted and fixed at the notch.

74. The mobile telecommunication apparatus according to claim 71, wherein the antenna projects from both surfaces of the board.

75. The mobile telecommunication apparatus according to claim 35, wherein said first radiation-conductive element has a length substantially equal to 1/2 wavelength of the first frequency band.

76. The mobile telecommunication apparatus according to claim 75, wherein said second radiation-conductive element has a length substantially equal to 1/2 wavelength of the second frequency band.

77. The mobile telecommunication apparatus according to claim 35, wherein said second radiation-conductive element has a length substantially equal to 1/2 wavelength of the second frequency band.

* * * * *